US005775973A

United States Patent [19]

Watanabe

[11] Patent Number: 5,775,973

[45] Date of Patent: Jul. 7, 1998

[54] METHOD AND APPARATUS FOR GRINDING THE RIM OF A LENS

[75] Inventor: Takahiro Watanabe, Tokyo, Japan

[73] Assignee: Kabushiki Kaisha Topcon, Tokyo, Japan

[21] Appl. No.: 843,702

[22] Filed: Apr. 16, 1997

[30] Foreign Application Priority Data

Apr. 17, 1996 [JP] Japan ..... 8-095429

[51] Int. Cl.[6] ..... B24B 49/00

[52] U.S. Cl. ..... 451/5; 451/10; 451/11; 451/43; 451/237; 451/240; 451/256

[58] Field of Search ..... 451/5, 9, 10, 11, 451/43, 237, 239, 240, 255, 256

[56] References Cited

U.S. PATENT DOCUMENTS

| | | | |
|---|---|---|---|
| 4,217,736 | 8/1980 | Akaba et al. | 451/43 |
| 4,612,736 | 9/1986 | Massard et al. | 451/43 |
| 4,912,880 | 4/1990 | Haddock et al. | 451/43 |
| 4,945,684 | 8/1990 | Wada et al. | 451/43 |
| 5,148,637 | 9/1992 | Byron | 451/43 |
| 5,398,460 | 3/1995 | Joncour | 451/43 |
| 5,538,459 | 7/1996 | Gottschald et al. | 451/11 |
| 5,549,503 | 8/1996 | Nauche et al. | 451/11 |
| 5,630,746 | 5/1997 | Gottschald et al. | 451/5 |
| 5,716,256 | 2/1998 | Mizuno et al. | 451/5 |

*Primary Examiner*—Eileen P. Morgan
*Attorney, Agent, or Firm*—Finnegan, Henderson, Farabow, Garrett & Dunner, L.L.P.

[57] ABSTRACT

A method of processing the rim of a lens is provided which includes the step of grinding the rim of a lens (LE) with a grindstone (6) so as to fit the configuration of an eyeglass frame while rotating and moving the lens (LE) toward and away from the grindstone (6) at intervals of a rotational angle ($n\Delta\theta$) in accordance with lens processing data ($\rho n$, $n\Delta\theta$) which have been measured by a configuration measuring portion (46). The method further includes the steps of, in accordance with the data ($\rho n$, $n\Delta\theta$) and the radius of curvature of the grindstone (6), obtaining a displacement angle ($d\theta n$) between an assumed processing point at a radius vector ($\rho n$) of the rotational angle ($n\Delta\theta$)[n=0, 1, 2, 3, . . . i] and a true processing point where the lens (LE) comes into contact with the grindstone (6) at the rotational angle ($n\Delta\theta$), and lowering a rotational angular speed of the lens (LE) at an angular interval (n) between ($n-1\Delta\theta$) and ($n\Delta\theta$) as the displacement angle ($d\theta n$) at the rotational angle ($n\Delta\theta$) becomes larger so that the ground quantity of the rim of the lens (LE) becomes substantially constant.

8 Claims, 15 Drawing Sheets

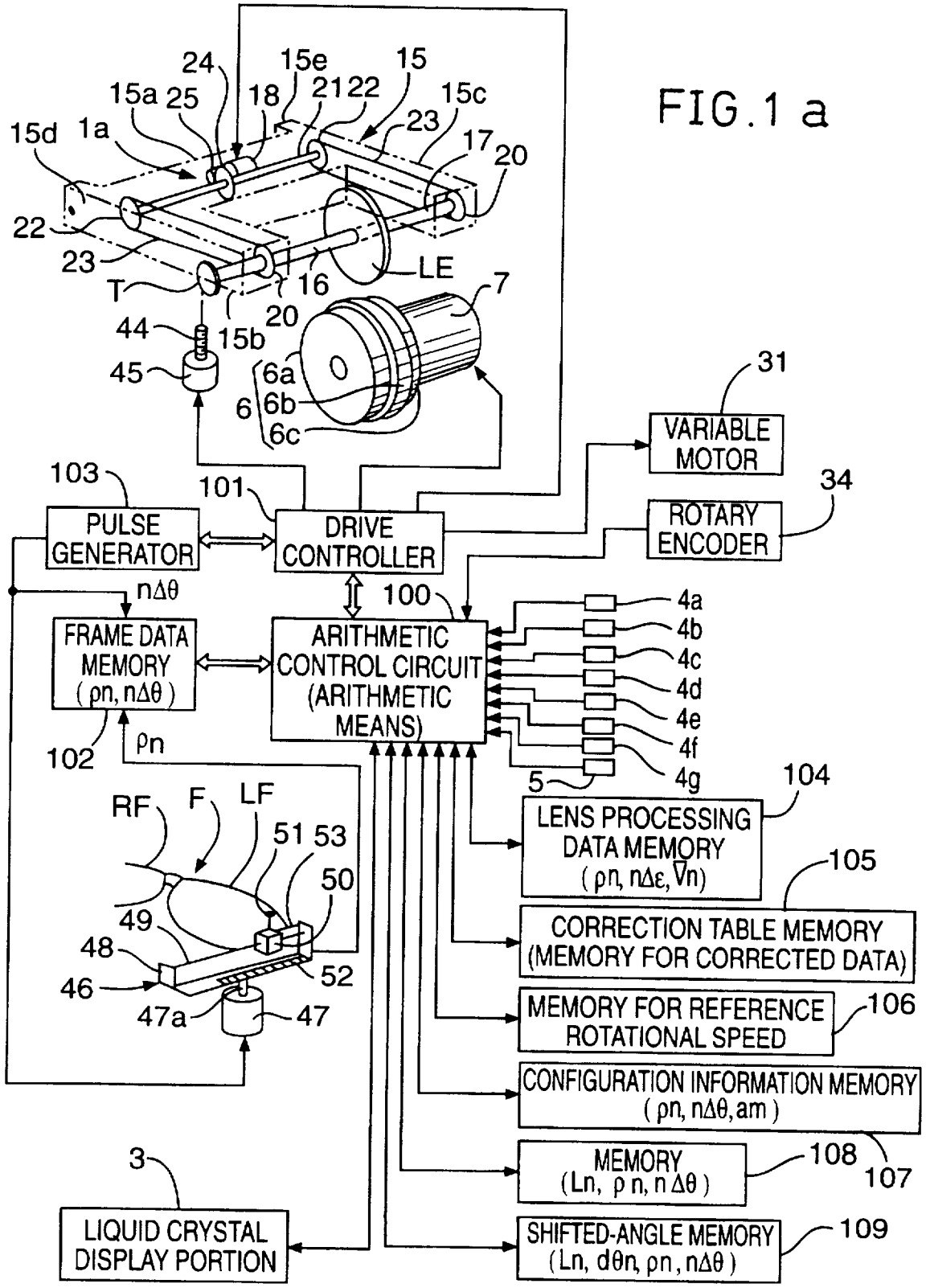
FIG. 1 a
24
15e
15
15a
25
18
21
22
15c
15d
1a
23
17
20
22
23
T
16
LE
7
44
15b
20
45
6a
6
6b
6c
31
VARIABLE MOTOR
103
101
34
PULSE GENERATOR
DRIVE CONTROLLER
ROTARY ENCODER
nΔθ
100
4a
4b
4c
4d
4e
4f
4g
FRAME DATA MEMORY (ρn, nΔθ)
ARITHMETIC CONTROL CIRCUIT (ARITHMETIC MEANS)
102
ρn
5
104
RF
F
LF
51
53
50
LENS PROCESSING DATA MEMORY (ρn, nΔε, ∇n)
105
49
48
52
CORRECTION TABLE MEMORY (MEMORY FOR CORRECTED DATA)
46
47a
47
MEMORY FOR REFERENCE ROTATIONAL SPEED
106
CONFIGURATION INFORMATION MEMORY (ρn, nΔθ, am)
3
MEMORY (Ln, ρn, nΔθ)
108
107
LIQUID CRYSTAL DISPLAY PORTION
SHIFTED-ANGLE MEMORY (Ln, dθn, ρn, nΔθ)
109

FIG.6 a

| ROTATIONAL ANGLE $n\Delta\theta$ (DEGREE) ($\Delta\theta$=0.36) | 0.0 | 0.36 | 0.72 | 1.08 | 1.44 | 1.8 | 2.16 | ... | 287.64 | 288 | 288.36 | ... | 359.64 | 360(0.0) |
|---|---|---|---|---|---|---|---|---|---|---|---|---|---|---|
| INTERVAL NO.(n) | 1 | 2 | 3 | 4 | 5 | 6 | 7 | ... | 800 | 801 | 802 | ... | 1000 | |
| SHIFTED ANGLE $\delta n$ (DEGREE) | 0 | 0 | 0.36 | 0.72 | 0.36 | 2.52 | 5.4 | ... | 0 | 4.68 | 9 | ... | 0 | |
| ROTATIONAL SPEED CORRECTION CODE $\alpha m$ | 0 | 0 | 0 | 0 | 0 | 1 | 1 | | 0 | 2 | 2 | | 0 | |
| CORRECTED ROTATIONAL SPEED $n\theta V$ | 15 | 15 | 15 | 15 | 15 | 22.5 | 22.5 | | 15 | 33 | 33 | | 15 | |

FIG.6b

TIME TAKEN FOR ONE ROTATION OF LENS AXIS (Vbi)

| | COARSE (Vb1) PROCESSING | V-SHAPED (Vb2) PROCESSING | PLANE (Vb3) PROCESSING | SPECULAR (Vb4) PROCESSING |
|---|---|---|---|---|
| GLASS | 10 Sec. | 12 Sec. | 12 Sec. | 15 Sec. |
| PLASTICS | 8 Sec. | 12 Sec. | 12 Sec. | 15 Sec. |
| POLYCARBONATE | 13 Sec. | 13 Sec. | 13 Sec. | 20 Sec. |
| ACRYLIC | 13 Sec. | 13 Sec. | 13 Sec. | 20 Sec. |

FIG.6c

CORRECTION TABLE (COEFFICIENT Ki)

| | STRAIGHT-LINE JUDGMENT (K1) | CONCAVE JUDGMENT (K2) | OTHER JUDGMENT (K0) |
|---|---|---|---|
| GLASS | 1.3 | 1.8 | 1.0 |
| PLASTICS | 1.5 | 2.2 | 1.0 |
| POLYCARBONATE | 1.5 | 2.5 | 1.0 |
| ACRYLIC | 1.5 | 2.2 | 1.0 |

FIG. 9a
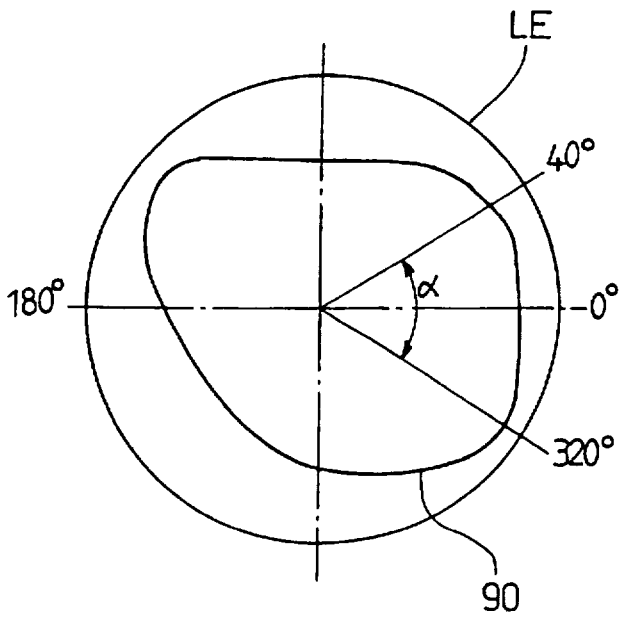
FIG. 9b
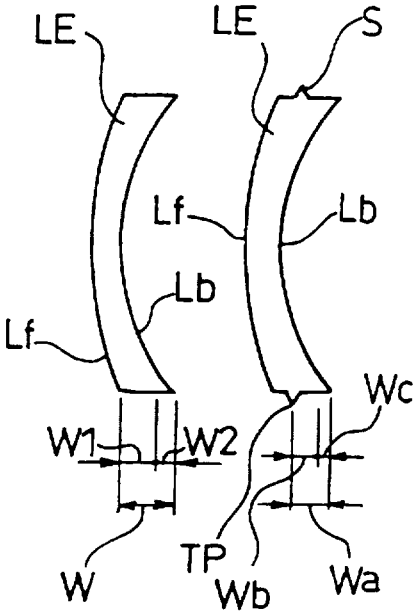
FIG. 9c
FIG. 9d
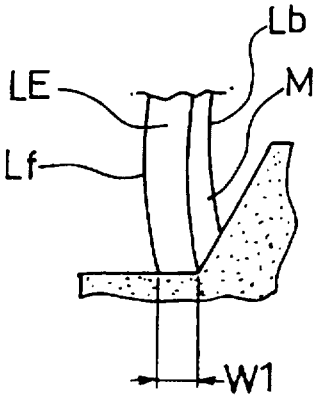
FIG. 9e
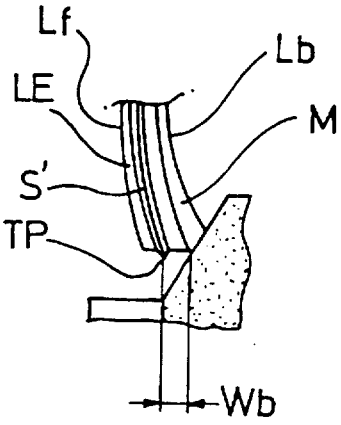

METHOD AND APPARATUS FOR GRINDING THE RIM OF A LENS

BACKGROUND OF THE INVENTION

1. Field of the Invention

This invention relates to a method and apparatus for grinding the rim of a lens into the configuration of a spectacle lens.

2. Description of the Prior Art

In a conventional apparatus for grinding the rim of a lens, a carriage is attached to an apparatus body pivotably on the rear part of the apparatus body upward and downward, a pair of lens rotating shafts are coaxially disposed and are rotatably held by right-hand and left-hand projections of the carriage, one of the lens rotating shafts being movable toward and away from the other lens rotating shaft, a rotation driving means is provided for rotating the lens rotating shafts, an up-and-down means is provided for driving rotationally the other lens rotating shaft upward and downward, a grindstone is disposed below a lens held between the pair of lens rotating shafts and is held rotatably by the apparatus body, and an arithmetic control circuit is provided for controlling the rotation driving means and the up-and-down means in accordance with information ($\rho n$, $n\Delta\theta$) on the configuration of an eyeglass.

The configuration of a lens frame of an eyeglass frame, a ground model (a lens model) of a rimless frame, and the like, are used as the eyeglass-configuration information ($\rho n$, $n\Delta\theta$). The eyeglass-configuration information is usually measured by a device for measuring the configuration of a lens frame, such as a frame reader, and then is transmitted to the lens grinding apparatus. Note that the eyeglass configuration is not a circular configuration but an intricate configuration having a circular arc portion of curvature, a straight line portion, a concave circular arc portion, and the like.

The arithmetic control circuit of the lens processing apparatus drives rotationally the lens rotating shafts by controlling the rotation driving means and rotates the lens held between the lens rotating shafts, while moving the carriage up and down by controlling and operating the up-and-down means in accordance with the aforementioned configuration information ($\rho n$, $n\Delta\theta$). In this way, the rim of the lens is ground into the configuration of the eyeglass by the grindstone.

At this time, as shown in FIG. 15*a*, a lowest position where the lens rotating shaft is moved down by the weight of the carriage itself is adjusted at intervals of a rotational angle $n\Delta\theta$ by the up-and-down means. Thereby, a distance Ln between a rotational axis 01 of the lens rotating shaft in the rotational angle $n\Delta\theta$ and a rotational center (a rotational-axis line) 02 of the grindstone Q is corrected to grind the lens LE into the eyeglass configuration.

In this grinding process, the lens LE is in contact with the grindstone Q in an assumed straight line S by which the lens rotational center 01 is connected to the rotational center 02 of the grindstone Q at the maximum radius vector $\rho$ max of the aforementioned configuration information ($\rho n$, $n\Delta\theta$). However, during the progress of the grinding of the rim of the lens, the lens LE comes into contact, with lower frequency, with the grindstone Q in the aforementioned assumed straight line S. Especially, when finish grinding (polishing) is carried out with a finishing grindstone (i.e., grindstone Q), the rim of the lens LE has substantially the configuration of an eyeglass. Thus, in a straight line portion La or a concave circular arc portion (not shown), the lens LE comes into contact with the grindstone Q not at a position P in the aforementioned assumed straight line S, as shown in FIG. 15*b*, but at a position P' displaced from the assumed straight line S in a circumferential direction. Therefore, the grindstone Q is moved to the position P on the assumed straight line S, and a rim portion Lb of the lens LE is ground, and thereby a so-called "processing interference" occurs.

In an acute-angle portion Lb of the rim of the lens LE, the quantity of movement of a contact position of the rim of the lens LE with the grindstone Q does not vary to a large extent regardless of a variation in slight rotational angle of the lens LE. On the other hand, in the straight line portion La or the concave circular arc portion, the quantity of movement of a contact position of the rim of the lens LE with the grindstone Q varies to a large extent even when the lens LE has been slightly rotated.

Accordingly, since time during which the grindstone Q is in contact with the lens LE depends on the configuration of an eyeglass, the grindstone Q stays in the acute-angle portion Lb longer, while the grindstone Q stays in the straight line portion La shorter. Consequently, in the conventional grinding method, the configuration of an eyeglass cannot be obtained with accuracy in accordance with configuration information ($\rho n$, $n\Delta\theta$) about the configuration of the eyeglass even though the accurate configuration information ($\rho n$, $n\Delta\theta$) thereabout has been obtained.

SUMMARY OF THE INVENTION

Hence, an object of the present invention is to provide a method of and an apparatus for grinding the rim of a lens, wherein the "processing interferences" can be controlled to be prevented by calculating a displacement angle of a contact position of a lens to be processed with a grindstone in a circumferential direction in accordance with the configuration of an eyeglass, and time during which the grindstone stays contacting with the lens is regulated in view of the quantity of displacement relative to the displacement angle so that the lens can be ground into the configuration of the eyeglass with accuracy.

In order to achieve the object, in a method of processing the rim of a lens according to the present invention, the rim of a lens to be processed is ground into the configuration of an eyeglass with a grindstone while the lens is being rotated and is moved toward and away from the grindstone at intervals of a rotational angle $n\Delta\theta$, according to lens processing data ($\rho n$, $n\Delta\theta$) measured by a configuration measuring means for measuring the configuration of a lens frame. Additionally, in this processing method, a displacement angle $d\theta n$ is calculated between an assumed processing point at a radius vector $\rho n$ of the rotational angle $n\Delta\theta$ [n=0, 1, 2, 3, . . . i] and a true processing point where the lens comes into contact with the grindstone at the rotational angle $n\Delta\theta$, from the data ($\rho n$, $n\Delta\theta$) and the radius of curvature of the grindstone.

Further, in the lens processing method, from the data ($\rho n$, $n\Delta\theta$) and the curvature radius of the grindstone, a displacement angle $d\theta n$ is calculated between the assumed processing point at the radius vector $\rho n$ of the rotational angle $n\Delta\theta$ [n=0, 1, 2, 3, . . . i] and the true processing point where the lens comes into contact with the grindstone at the rotational angle $n\Delta\theta$, and thereafter, according to the displacement angle $d\theta n$ at the rotational angle $n\Delta\theta$, a rotational angular rate of the lens is controlled to make time during which the grindstone stays at the rotational angle $n\Delta\theta$ substantially constant.

In order to achieve the object, an apparatus for processing the rim of a lens according to the present invention comprises a pair of lens rotating shafts which are coaxially disposed and holds a lens to be processed therebetween, a rotation driving means for rotating the lens rotating shafts, a rotatable grindstone disposed below the lens, up-and-down means for raising and lowering the lens rotating shafts in accordance with processing data (ρn, nΔθ) measured by a configuration measuring means for measuring the configuration of a lens frame, and an arithmetic control circuit for controlling the rotation driving means and the up-and-down means. In this apparatus, the arithmetic control circuit is designed to obtain a displacement angle dθn between an assumed processing point P at a radius vector ρn of the rotational angle nΔθ |n=0, 1, 2, 3, . . . i| and a true processing point P' where the lens comes into contact with the grindstone at the rotational angle nΔθ, according to the processing data (ρn, nΔθ) and the radius R of curvature of the grindstone.

Further, the arithmetic control circuit in the apparatus can be designed to obtain a displacement angle dθn between the assumed processing point P at the radius vector ρn of the rotational angle nΔθ |n=0, 1, 2, 3, . . . i| and the true processing point P' where the lens comes into contact with the grindstone at the rotational angle nΔθ according to the processing data (ρn, nΔθ) and the radius R of curvature of the grindstone, and control a rotational angular rate of the lens rotating shafts so that time during which the grindstone stays at the rotational angle nΔθ is made substantially constant according to the displacement angle dθn.

Further, the arithmetic control circuit in the processing apparatus according to the present invention can be designed to, if the displacement angle dθn is smaller than a predetermined angle value Δθx, judge that the lens has a configuration to be ground at a predetermined reference speed and allow a configuration information memory to store a rotational speed correction code am in the name of a1 at which a corrected rotational speed Vn corresponds to v1, and, if the displacement angle dθn is between the predetermined value Δθx and a predetermined value Δθy (Δθx<Δθy), judge that the lens has the configuration of a straight line and allow the configuration information memory to store the rotational speed correction code am in the name of a2 at which the corrected rotational speed Vn corresponds to v2 (v1<v2). And if the displacement angle dθn is larger than the predetermined value Δθy, the arithmetic control circuit judges that the lens has a concave configuration and allow the configuration information memory to store the rotational speed correction code am in the name of a3 at which the corrected rotational speed Vn corresponds to v3 (v2<v3), and, when grinding the rim of the lens with the grindstone, the arithmetic control circuit calls one of the rotational speed correction codes a1, a2, and a3 which have been stored at intervals of nΔθ in the configuration information memory and controls the rotation driving means so that the corrected rotational speed Vn of the lens corresponds to any one of v1, v2, and v3 (v1>v2>v3).

Further, in the apparatus, the rotational speeds v1, v2, v3 can be designed to depend on the material of the lens.

Further, the arithmetic control circuit in the apparatus according to the present invention can be designed to call a correction coefficient ki corresponding to the reference rotational speed and the rotational speed correction code am depending on the material of the lens from a memory for a reference rotational speed and a correction table memory, respectively, then read the rotational speed correction code am at intervals of nΔθ, then find the corrected rotational speed Vn of the lens at intervals of nΔθ according to the read rotational speed correction code am, the speed correction coefficient k1, and the reference rotational speed, then allow a lens processing data memory to store the corrected rotational speed Vn as processing data (ρn, nΔθ, Vn) as well as the data (ρn, nΔθ), and control the rotation driving means according to the processing data (ρn, nΔθ, Vn) which have been stored in the lens processing data memory.

Further, in the apparatus, the grindstone comprises a coarse grindstone and a fine abrasive grindstone, and the fine abrasive grindstone can has an inclined slim-processing grinding surface used for edge-chamfering on the circumferential surface thereof.

BRIEF DESCRIPTION OF THE DRAWINGS

FIG. 1*a* is a control circuit of an apparatus for grinding a lens according to the present invention.

FIG. 6*a* is a table showing data which are stored in the memory shown in FIG. 1*a*, FIG. 6*b* is a table showing a reference rotational speed per rotation of a lens shaft (a lens rotating shaft) which depends on the material of a lens to be processed, and FIG. 6*c* is a table showing a correction coefficient depending on the material of the lens.

FIG. 9*a* is a descriptive drawing showing the relationship between the lens to be processed (i.e., circular lens blank) and the configuration of an eyeglass, FIG. 9*b* is a sectional view of the lens shown in FIG. 9*a* which has been shaped into the configuration of the eyeglass by plane processing, FIG. 9*c* is a sectional view of the lens shown in FIG. 9*a* which has been shaped into the configuration of the eyeglass by V-edge processing, FIG. 9*d* is a descriptive drawing of the lens shown in FIG. 9*b* which has been chamfered, and FIG. 9*e* is a descriptive drawing of the lens shown in FIG. 9*c* which has been chamfered.

DESCRIPTION OF THE PREFERRED EMBODIMENTS

Embodiments of the present invention will be described hereunder with reference to the attached drawings.

First Embodiment

<Grinding Portion>

Figure 2:
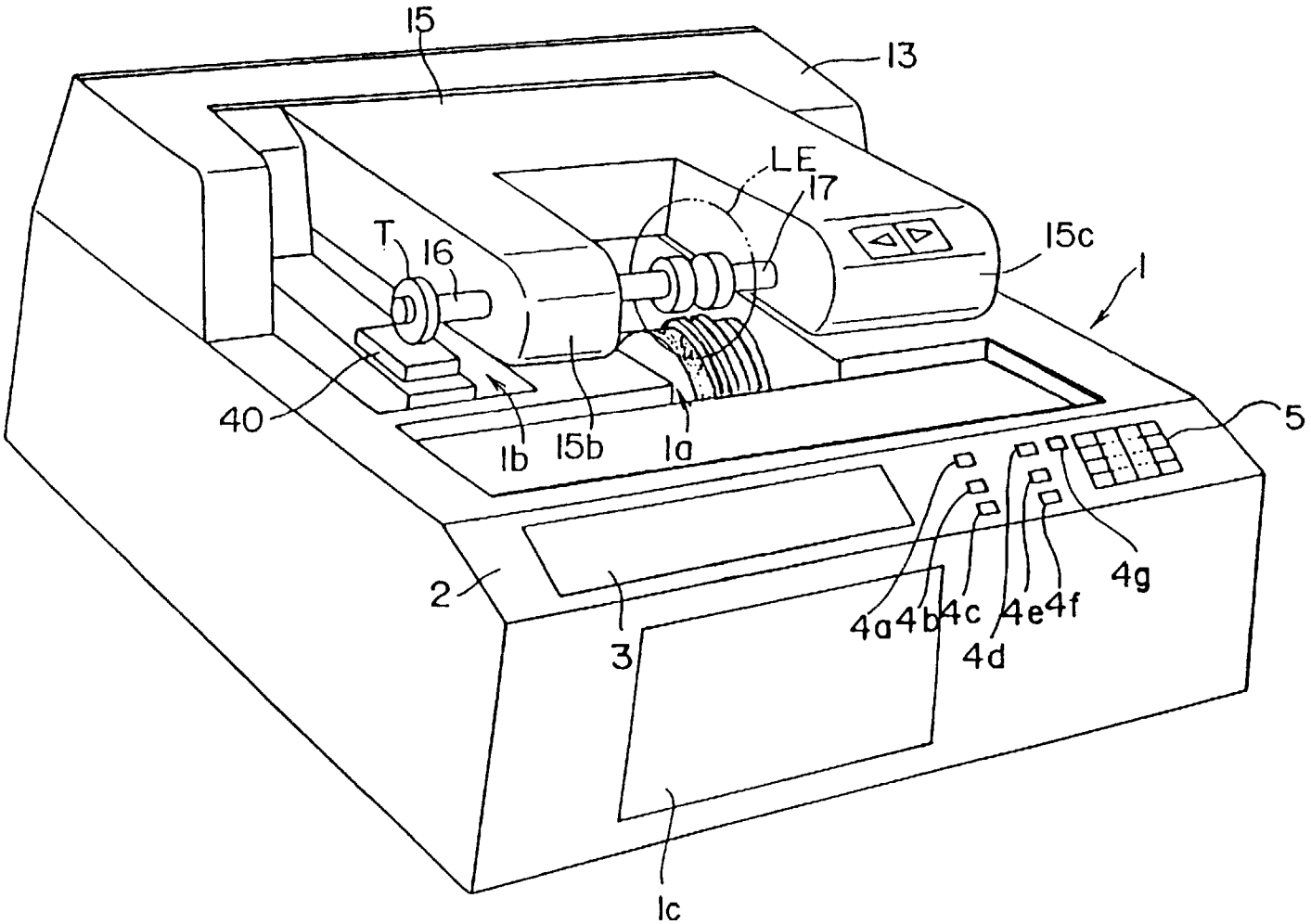
FIG. 2 is a schematic perspective view of an apparatus for processing the rim of a lens which includes the control circuit shown in FIG. 1*a*.

In FIG. 2, reference character 1 denotes a box-shaped body of an apparatus for processing the rim of a lens, 2 denotes an inclined plane formed in the front upper part of the body 1, 3 denotes a liquid crystal display portion disposed in the left half part of the inclined plane 2, and 4 denotes a keyboard portion disposed in the right part of the inclined plane 2.

The keyboard 4 consists of a switch 4*a* used for a FPD input mode, a switch 4*b* used for a PD input mode, a switch 4*c* used for a bridge-width input mode, a switch 4*d* used for selecting the quality of a lens material, a switch 4*e* used for switching a mode over, a switch 4*f* used for starting measurement, a switch 4*g* used for processing, ten keys 5, and the like.

Concave portions 1*a*, 1*b* are each formed in the middle, and in the left, Of the body 1, and a grindstone 6 (a grindstone wheel) which is held rotatably on the body 1 is disposed in the concave portion 1*a*. As shown in FIG. 1*a*, the grindstone 6 consists of a coarse grindstone 6*a*, a grindstone 6*b* having V-shaped grooves (a mortar-processing grindstone), and a finishing grindstone 6*c* (a fine abrasive grindstone). The grindstone 6 is designed to be rotated by a motor 7 shown in FIG. 1*a*.

Figure 3:
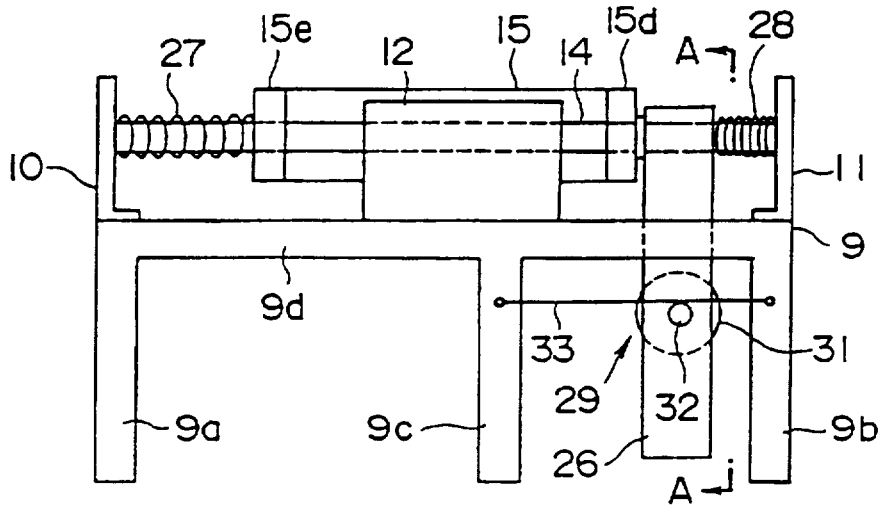
FIG. 3 is a front view of a part to which the carriage shown in FIG. 1*a* is attached.

As shown in FIG. 3, a hold stand 9 used for holding a carriage is fixed in the body 1. The hold stand 9 consists of right and left leg portions 9*a*, 9*b*, a middle leg portion 9*c* which is formed in a position nearer to the leg portion 9*b* between the leg portions 9*a*, 9*b*, and an attachment plate portion 9*d* which is connected with the top ends of the leg portions 9*a* to 9*c*.

Brackets 10, 11 used for attaching a shaft are projected from each end parts of the attachment plate portion 9*d*, and a projection 12 for holding a shaft are projected from the middle part of the attachment plate portion 9*d*. The brackets 10, 11 and the shaft-holding projection 12 are covered with a cover 13 having a U-shaped plan-view configuration, shown in FIG. 2. The each end of a holding shaft 14 penetrating the shaft-holding projection 12 is fixed to the brackets 10, 11, respectively.

<Carriage>

A carriage 15 is disposed on the body 1. The carriage 15 consists a carriage body 15*a*, arm portions 15*b*, 15*c* which extend forward and parallel to each other on the both sides of the carriage body 15*a* and are united with the carriage body 15*a*, respectively, and projections 15*d*, 15*e* which project backward on the both sides of the carriage body 15*a*, respectively.

As shown in FIG. 3, the projections 15*d*, 15*e* are disposed in a position where the shaft-holding projection 12 is laid therebetween, and are held on the holding shaft 14 so as to be rotatable around the axial line of the holding shaft 14 and also to be movable in the longitudinal direction (the right and left direction) of the holding shaft 14. Thereby, the front end part of the carriage 15 is designed to be pivotable in the up and down direction on the holding shaft 14.

A lens rotating shaft 16 is held rotatably in the arm portion 15*b* of the carriage 15, and a lens rotating shaft 17 which is disposed in the same axis as the lens rotating shaft 16 is held in the arm portion 15*c* of the carriage 15 such that it can be rotated and adjustably moved forward to and backward from the lens rotating shaft 16. A lens LE to be processed is designed to be held between the ends where the lens rotating shafts 16, 17 face each other (between ends of the lens rotating shafts 16, 17). A disk T is removably attached to the other end of the lens rotating shaft 16 by a fixing means (not shown). Herein, the fixing means has a well-known structure.

The lens rotating shafts 16, 17 are designed to be driven rotationally by a gear for driving rotationally a shaft (means for driving rotationally a shaft). The shaft-rotationally-driving gear is provided with a pulse motor 18 (rotation driving means) which is fixed in the carriage body 15*a*, and a power transmitting mechanism 19 (power transmitting means) for transmitting rotation of the pulse motor 18 to the lens rotating shafts 16, 17.

The power transmitting mechanism 19 consists pulleys 20, 20 each of which is attached to each of the lens rotating shafts 16, 17, a rotational shaft 21 which is held rotatably in the carriage body 15*a*, pulleys 22, 22 each of which is fixed to the each end of the rotational shaft 21, timing belts 23 each of which is laid between the pulleys 20, 22, a gear 24 which is fixed to the rotational shaft 21, a pinion 25 used for the power of the pulse motor 18, and the like.

The rear part of a holding arm 26 which is disposed in the concave portion 1*a* of the body 1 is held to the holding shaft 14 in a state of being movable in the right and left directions. The holding arm 26 is held to be rotatable relatively to and also to be movable in the right and left directions together with the carriage 15. Herein, the middle part of the holding arm 26 is hold moveably in the right and left directions in the body 1 by a shaft (not shown).

A spring 27 which is coiled around the holding shaft 14 is disposed between the holding arm 26 and the bracket 10, and a spring 28 is disposed between the body 1 and the bracket 11. The carriage 15 stops in a position where the forces of the springs 27, 28 balance, and in the stop position, the lens LE held between the lens rotating shafts 16, 17 is designed to be positioned on the coarse grindstone 6*a*.

<Carriage-Transversely-Moving Means>

The carriage 15 is disposed moveably in the right and left directions by means 29 for moving a carriage transversely.

The carriage-transversely-moving means 29 includes a U-shaped bracket 30 which is fixed to the front surface of the holding arm 26, a variable motor 31 which is positioned inside the bracket 30 and is fixed to the front surface of the holding arm 26, a pulley 32 which is fixed to a power axis 31*a* that is attached to the variable motor 31 and also that penetrates the holding arm 26, and a wire 33 whose ends are fixed to the leg portion 9*b*, 9*c* of the hold stand 9 and which is coiled around the pulley 32.

Further, the carriage-transversely-moving means 29 includes a rotary encoder 34 (detecting means) which is fixed to the bracket 30, and a coupling 35 which makes a connection between a rotational axis 34*a* of the rotary encoder 34 and a power axis 31*b* of the variable motor 31. Herein, when electricity of the variable motor 31 is turned off, the power axis 31*b* is brought into a state of being rotatable.

<Carriage-Upward-And-Downward-Moving Means>

Figure 4:
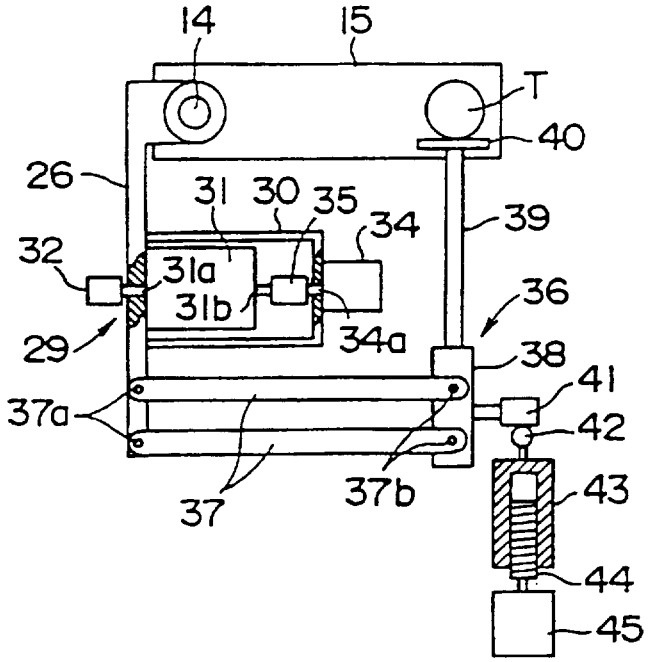
FIG. 4 is a partially sectional view of the part to which the carriage shown in FIG. 1*a* is attached, taken along line A—A of FIG. 3.
Figure 5:
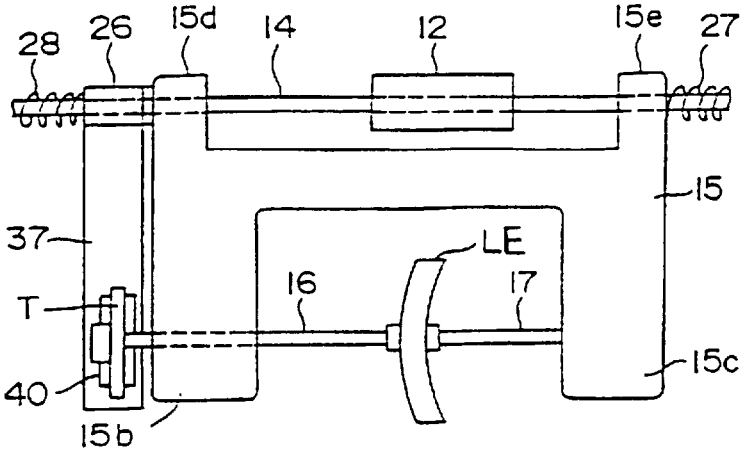
FIG. 5 is a partial front view of the carriage shown in FIG. 1*a*.

A means 36 for moving a carriage upward and downward is, as shown in FIG. 4, disposed below a position corresponding to a disk T.

The carriage-upward-and-downward-moving means 36 includes links 37, 37 whose base ends are attached pivotably on pivots 37*a*, 37*a* to the holding arm 26 and whose free ends can pivot up and down, a link 38 which is attached pivotably on pivots 37*b*, 37*b* to the free ends of the links 37, 37, a holding rod 39 which projects upward to the link 38, and a plate-shaped platform 40 which is attached to the top end of the holding rod 39.

Further, the carriage-upward-and-downward-moving means 36 includes a shaft member 41 which is disposed perpendicularly to the holding rod 39 and projects forward, a bearing member 42 which extends in a direction where the carriage 15 moves and holds the shaft member 41, a female screw cylinder 43 which is united with the bearing member 42 and is held in a position (not shown) of the body 1 in a state of not being rotatable in the circumferential direction and also of being movable in the up and down direction, a male screw 44 which is engaged with the female screw cylinder 43, and a pulse motor 45 which is fixed to the body 1 and drives rotationally the male screw 44.

<Eyeglass-Lens-Configuration-Measuring Portion (Eyeglass-Lens-Configuration-Measurement Apparatus)>

A lid 1*c* is disposed on the front side of the body 1, and a portion 46 for measuring the configuration of an eyeglass, which is used as means for measuring the configuration of an eyeglass, is disposed inside the apparatus body 1. Herein, the lid 1*c* is opened, and thus the eyeglass-configuration-measuring portion 46 is designed to be capable of being taken in and out.

As shown in FIG. 1*a*, the eyeglass-configuration-measuring portion 46 includes a pulse motor 47, a rotational arm 48 which is attached to a power shaft 47*a* of the pulse motor 47, a rail 49 which is held on the rotational arm 48, a feeler holding body 50 which is movable in the longitudinal direction along the rail 49, a feeler 51 (a contact maker) which is attached to the feeler holding body 50, an encoder 52 which detects a movement distance of the feeler holding body 50, and a spring 53 which presses the feeler holding body 50 in a direction. A magnet scale, a liner encoder, or the like can be used as the encoder 52.

Incidentally, the lens-frame-configuration-measuring portion 46 may be constructed to be united with the lens-processing apparatus. Further, it may also be constructed to be separated from the lens-processing apparatus so as not to be connected electrically therewith. In this construction, the lens-frame-configuration data which have been measured by the lens-frame-configuration-measuring apparatus separated from the lens-processing apparatus are once inputted in a floppy disk or an IC card, and the lens-processing apparatus is provided with a reading device for reading the data from the storage medium, or the lens-frame-configuration data are inputted in the lens-processing apparatus from an eyeglass frame maker through the on-line information processing system.

Figure 1B:
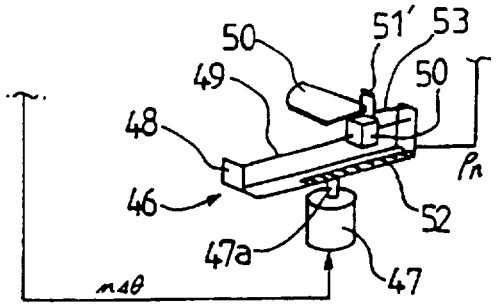
FIG. 1*b* is a perspective view of a configuration measuring means, showing another example of the configuration measuring means shown in FIG. 1*a*.

In FIG. 1*a*, the beveled feeler 51 is used for measurement of the configuration of a frame (a lens frame), however, the present invention is not limited to the feeler 51. For example, as shown in FIG. 1*b*, a semicylindrical feeler 51' which is used for the lens-frame-configuration measurement of a form plate (a grinding form) of a rimless frame, instead of the feeler 51, may be attached to the feeler holding body 50, or both of the feelers 51, 51' may be attached to the feeler holding body 50. Further, a feeler having a flat-plate shape, instead of the beveled feeler, may be used for measurement of the configuration of a frame (a lens frame. A structure which is disclosed by Japanese Patent Application No. Hei 7-10633 can be used as the structure where both of the feelers 51, 51' are attached to the feeler holding body 50. An eyeglass-configuration-measuring apparatus which is different from a grinding machine disclosed by Japanese Patent Application No. Hei 7-10633 can also be used.

<Control Circuit>

A control circuit includes an arithmetic control circuit 100 (control means). The liquid crystal display portion 3, the FPD-input-mode switch 4*a*, the PD-input-mode switch 4*b*, the bridge-width-input-mode switch 4*c*, the lens-material-quality-selecting switch 4*d*, the other mode-switching-over switch 4*e*, the measurement-starting switch 4*f*, the processing-starting switch 4*g*, the ten keys 5, and the like, are connected with the arithmetic control circuit 100.

Further, the rotary encoder 34, a drive controller 101, and a frame data memory 102 are connected with the arithmetic control circuit 100. A pulse generator 103, as well as the aforementioned motor 7 of a grinding portion, the pulse motor 18, the variable motor 31, the pulse motor 45, and the like, are connected with the drive controller 101. The pulse motor 47 is connected with the pulse generator 103, and the encoder 52 of the eyeglass-configuration-measuring portion 46 is connected with the frame data memory 102.

Further, a lens processing data memory 104, a correction table memory 105 (a memory used for correction data), a memory 106 used for the reference rotational speed of the lens rotational shaft, a configuration information memory 107, a memory 108 used for a distance between the shafts, and a displaced-angle memory 109, are connected with the arithmetic control circuit 100.

Next, there will be explained a function as well as an effect of the arithmetic control circuit 100.

(A) Calculation Of Data Used For Lens-Rim-Processing (1) Measurement Of An Eyeglass-Lens-Configuration After an electric source (not shown) has been turned on, the switch 4*e* is operated to become a measurement mode of an eyeglass configuration, such as the lens-frame configuration of an eyeglass frame F (the lens configuration of an eyeglass which is set in a lens frame), or the configuration of a grinding plate (a form plate) of a rimless frame (an eyeglass configuration). Then, the lid 1*c* is opened, and the eyeglass-configuration-measuring portion 46 inside the apparatus body 1 is drawn out. Then, the eyeglass frame F, or the grinding plate, is set in a predetermined position, then the measurement-starting switch 4*f* is pressed, and thus measurement is started.

Thereby, the arithmetic control circuit 100 controls an operation of the drive controller 101, and generates a drive pulse from the pulse generator 103. Then, the arithmetic control circuit 100 operates the pulse motor 47 by means of the pulse, and rotates the rotational arm 48. Thereby, the feeler 51 is moved along the inner circumference of a lens frame RF or LF of the eyeglass frame F (an eyeglass frame).

In this operation, the aforementioned movement distance of the feeler 51 is detected by the encoder 52, and then is inputted as the radius vector length ρn in the frame data memory 102 (an eyeglass-configuration data memory). Then, a pulse which is equal to the pulse given to the pulse motor 47 from the pulse generator 103 is inputted as a rotational angle of the rotational arm 48, that is, the radius vector angle nΔθ, in the frame data memory 102. Besides the radius vector ρn and the radius vector angle nΔθ are designed to be stored as the eyeglass-configuration data (ρn nΔθ) [herein, n=0, 1, 2, 3, . . . j] by the frame data memory 102. In this embodiment, j is made 1,000, and the rotational angle $\Delta\theta$ is made one thousandth of one rotation (360°/1,000), that is, 0.36°.

(2) Calculation Of The Shifted Angle $d\theta n$.

Figure 10:
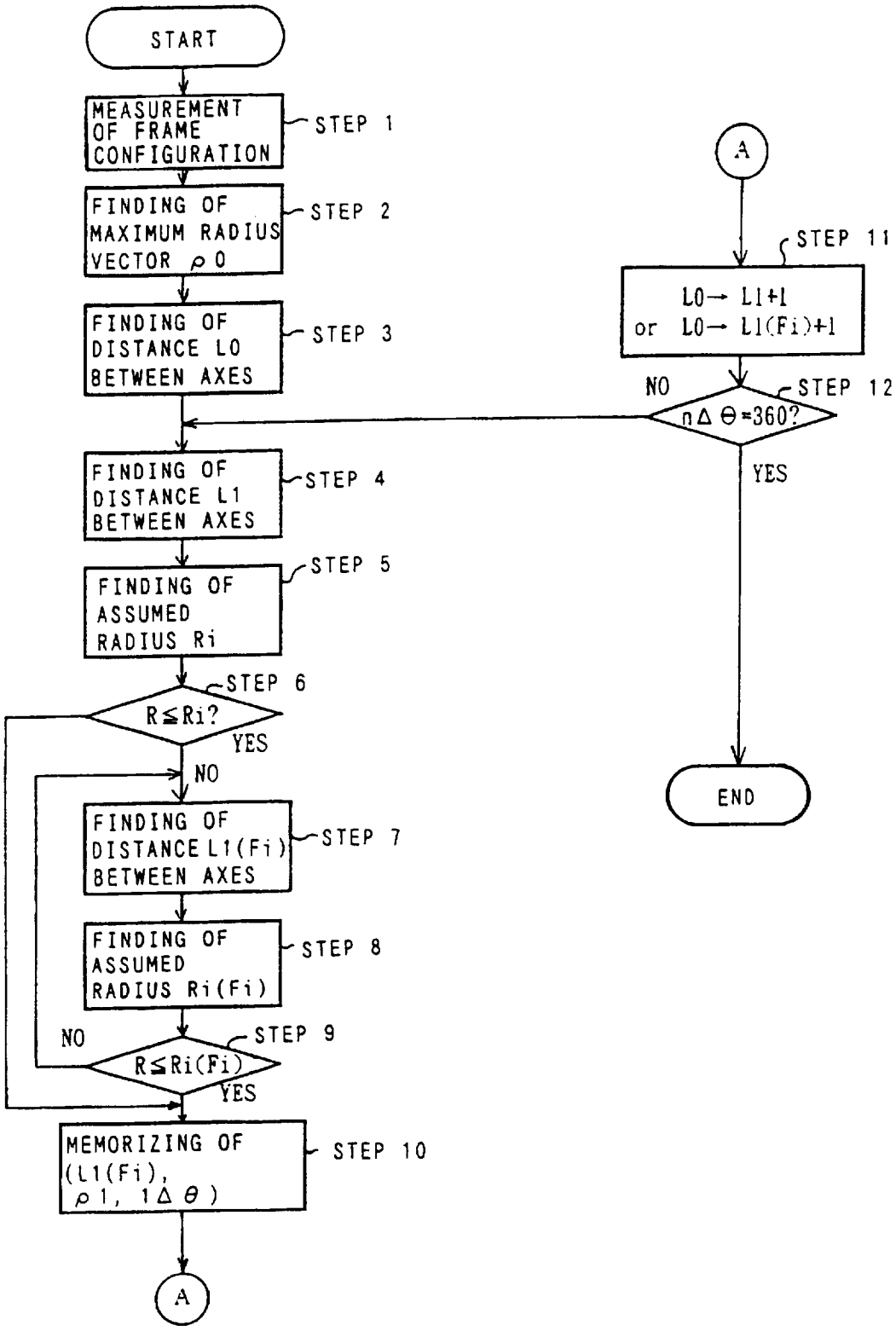
FIG. 10 is a flow chart of the grinding apparatus shown in FIG. 1*a*.

According to the eyeglass-configuration data ($\rho n$, $n\Delta\theta$), which are measured by the eyeglass-configuration-measuring portion 46 and are used for processing of the lens rim, and the curvature radius R of the grindstone, the arithmetic control circuit 100 calculates and obtains the displacement angle $d\theta n$ between the assumed processing point at the radius vector $\rho n$ of the rotational angle $n\Delta\theta$ and the true processing point where the lens comes into contact with the grindstone at the rotational angle $n\Delta\theta$, as shown in a flow sheet of FIG. 10.

STEP 1:

The frame-configuration-measuring portion 46 (a frame-configuration-measuring apparatus) which is used as frame-configuration-measuring means calculates and obtains the eyeglass configuration of, the lens frame F, a form plate which has been profiled by the lens frame F, or the lens model (a grinding form) of the rimless frame, that is, the radius vector information ($\rho n$, $n\Delta\theta$) (n=1, 2, 3, . . . N). Then, the information is stored by the frame data memory 102.

STEP 2:

According to the radius vector information ($\rho n$, $n\Delta\theta$) given from the frame data memory 102, the radius vector information ($\rho 0$, $0\Delta\theta$) having a maximum radius vector length $\rho 0$ is found.

Figure 11:
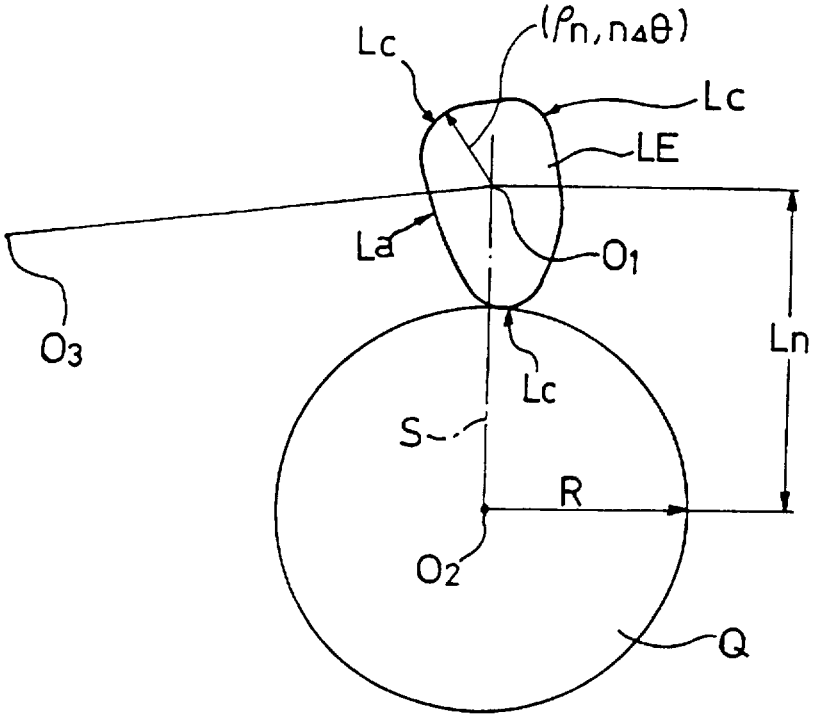
FIG. 11 is a descriptive drawing showing the relationship between the radius vector of the eyeglass and the radius of the grindstone, for explaining the flow chart shown in FIG. 10.

STEP 3:

The distance between the axis 02 of the lens rotating shafts 16, 17 at the time when the maximum radius vector information ($\rho 0$, $0\Delta\theta$) is processed, and the rotational axis 01 of the grindstone 6, is made L0 (see FIG. 11). Herein, the grindstone radius R known already and the radius vector length $\rho 0$ are substituted for equation $L0=\rho 0+R$, so that L0 can be calculated. Then, the processing information (L0, $\rho 0$, $0\Delta\theta$) is inputted in and stored by the memory 108.

STEP 4:

Next, the between-axes distance L1 at a processing point F0 where the radius vector having the maximum radius vector length $\rho 0$ comes into contact with the grindstone 6 at the time when the lens LE is rotated in the rotational angle $\Delta\theta$ is calculated. Herein, L1 can be calculated by the following equation, $$L1 = \rho 0\cos\Delta\theta + \sqrt{\rho 0^2\cos^2 - (\rho^2 - R^2)}$$

Figure 12:
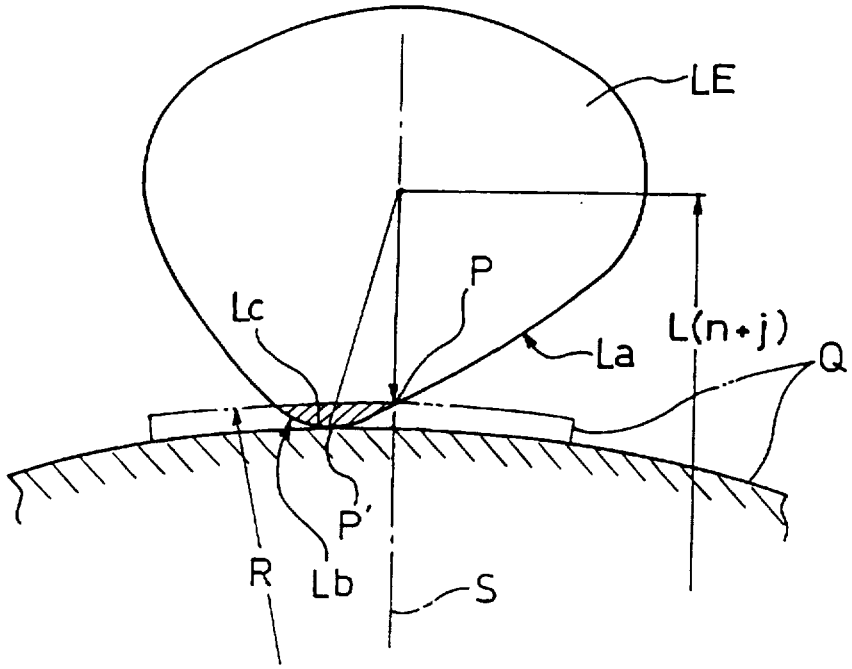
FIG. 12 is a descriptive drawing showing the relationship between the radius vector of the eyeglass and the radius of the grindstone, for explaining the flow chart shown in FIG. 10.

STEP 5:

In a state where the maximum radius vector $\rho 0$ is positioned at the processing point F0, assumed processing points F1, F2, . . . Fi, . . . FI of the radius vector information from the maximum radius vector to a predetermined I-th radius vector information ($\rho 1$, $1\Delta\theta$), ($\rho 2$, $2\Delta\theta$), . . . ($\rho i$, $i\Delta\theta$), . . . ($\rho I$, $I\Delta\theta$) are found, according to the radius vector information ($\rho n$, $n\Delta\theta$) of the frame data memory 102. In addition, assumed grindstone radii R1, R2, . . . Ri, . . . RI each of which is used to process each of the processing points are found (see FIG. 12).

STEP 6:

The true radius R of the grindstone 6 is compared with the radii Ri (i=1, 2, 3, . . . I) which have been obtained in the aforementioned STEP. Even though lens grinding is performed at the processing point F0 according to the maximum radius vector ($\rho 0$, $0\Delta\theta$) in the case where the relation between R and Ri is $R \leqq Ri$, the assumed processing points Fi (i=1, 2, 3, . . . i, . . . I) of the other radius vectors do not come into contact with the grindstone 6. Therefore, the displacement angles $d\theta i$ are prevented from appearing, so that "the interference of the grindstone" is not judged to be caused. In STEP 10, the processing information (L1, $\rho 1$, $1\Delta\theta$) at this time is inputted in and stored by the memory 108, and thereafter, the operation proceeds to STEP 11. On the other hand, in the case where it is R>Ri, the operation proceeds to STEP 7.

Figure 13:
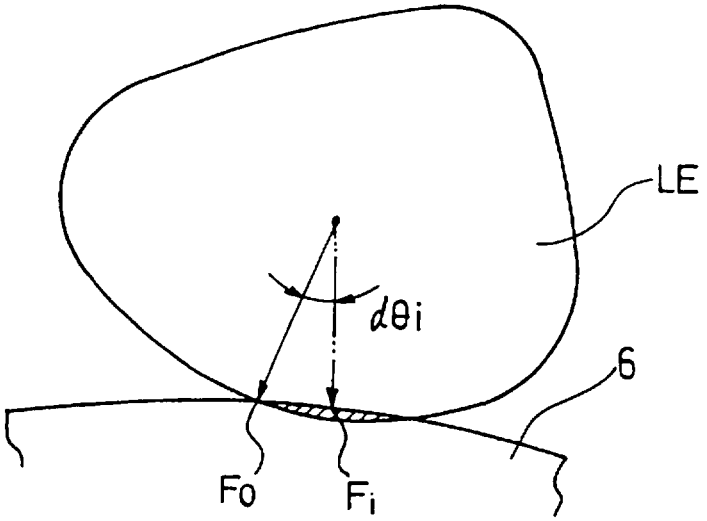
FIG. 13 is a descriptive drawing showing the relationship between the radius vector of the eyeglass and the radius of the grindstone, for explaining the flow chart shown in FIG. 10.
Figure 14:
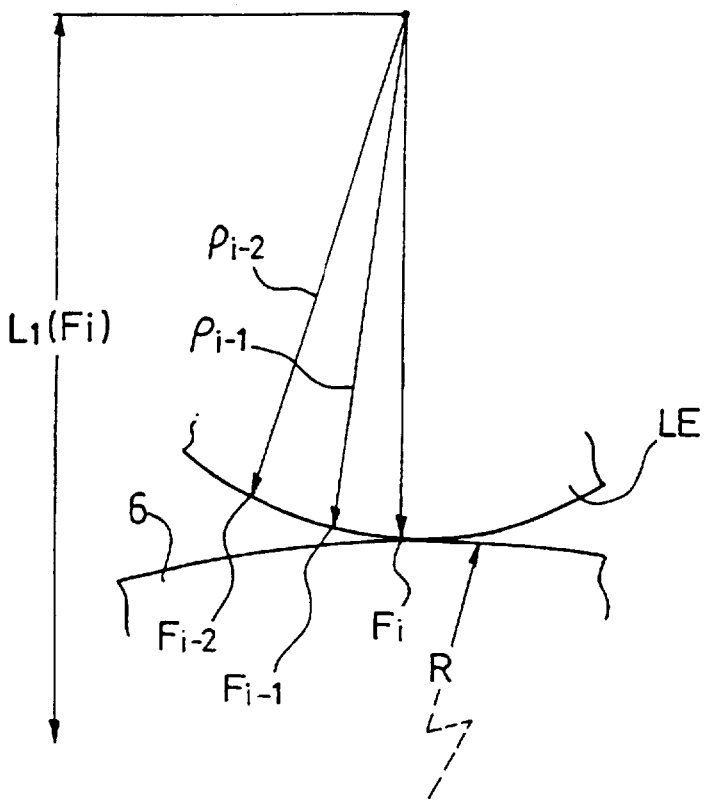
FIG. 14 is a descriptive drawing showing the relationship between the radius vector of the eyeglass and the radius of the grindstone, for explaining the flow chart shown in FIG. 10.
Figure 15A:
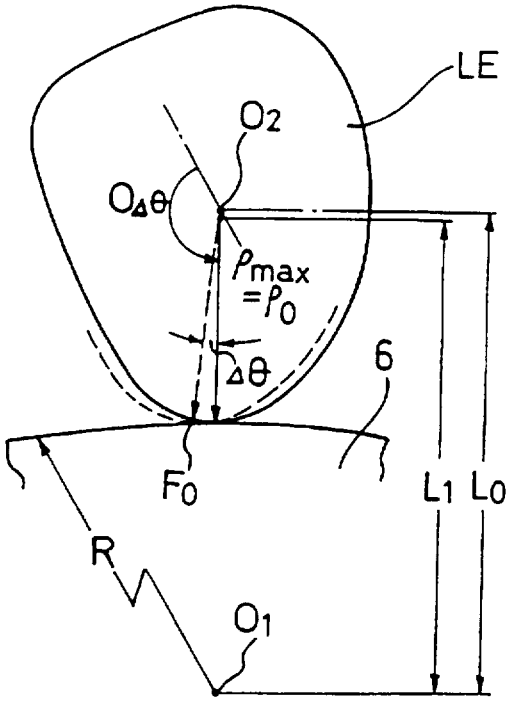
FIG.15a PRIOR ART
FIG. 15*a* is a descriptive drawing showing a conventional method of grinding and processing a lens.
Figure 15B:
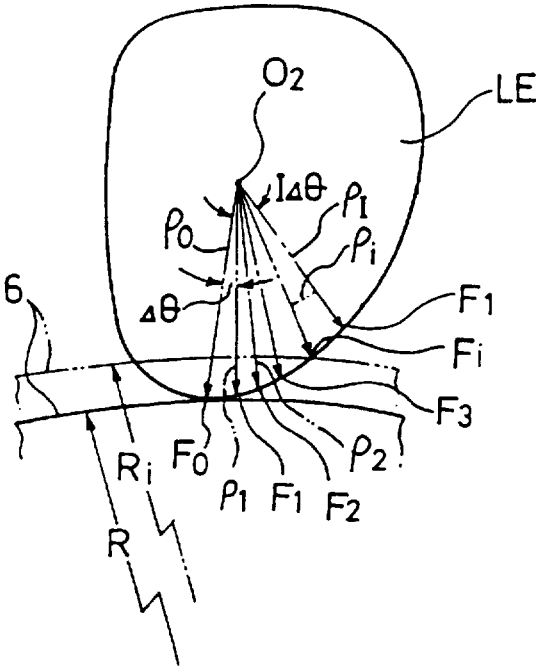
FIG.15b PRIOR ART
FIG. 15*b* is an enlarged descriptive drawing showing the lens of FIG. 15*a* in a position where it has been rotated.

STEP 7:

In the case where it is judged to be R>Ri in STEP 6, as shown in FIG. 13, the displacement angle $d\theta i$ caused by "the interference of the grindstone" appears in the assumed processing points Fi. In this case, the between-axes distance L1 (Fi) where the assumed (interference) processing point Fi is processed with the grindstone having a radius of R is calculated by the following equation (see FIG. 14), $$L1(Fi) = \rho i \cdot \cos(i\Delta\theta) + \sqrt{\rho i^2 \cdot \cos^2 i\Delta\theta - (\rho i - R^2)}$$

STEP 8:

The processing point F1 to be processed at the between-axes distance L1 (Fi) that has been obtained in STEP 7 is predetermined as a reference, in the same way as STEP 5. Each of the assumed processing points from the first to the I-th is found, and then the assumed grindstone Ri (Fi) is found.

STEP 9:

In the same way as STEP 6, the grindstone radius R in the case of the between-axes distance L1 (Fi) is compared with the assumed grindstone radius Ri (Fi) in STEP 8. In the case where it is $R \leqq Ri(Fi)$, the operation proceeds to STEP 10. In the case where it is R>Ri(Fi), the operation returns to STEP 7 in order to obtain the between-axes distance at a new interference point "ζ".

STEP 10:

In the case where it has become $R \leqq Ri(Fi)$ in STEP 9, the processing information (L1(Fi), $\rho 1$, $1\Delta\theta$) is inputted in and stored by the memory 108.

STEP 11:

It is considered whether or not "the interference of the grindstone" occurs with respect to the radius vector information ($\rho 1$, $1\Delta\theta$) in STEP 3 to STEP 10 mentioned above. In the case where it is judged to occur, the processing information (L1, $\rho 1$, $1\Delta\theta$) or (L1(Fi), $\rho 1$, $1\Delta\theta$) where it does not occur is considered to have been obtained. Consecutively, STEP 3 to STEP 10 are performed with respect to the subsequent radius vector ($\rho 2$, $2\Delta\theta$), and further, they are performed with respect to all of the other radius vectors.

STEP 12:

It is considered whether or not the displacement angle $d\theta n$ (n=0, 1, 2, 3, . . . i, . . . I) which is caused by "the interference of the grindstone" mentioned above appears with respect to $n\ \Delta\theta=360°$, that is, the whole radius vector information. In the case where it is judged to appear, it is judged whether or not the processing information (Ln, $\rho n$, $n\Delta\theta$) where it does not appear has been obtained. The processing information (Ln, $\rho n$, $n\Delta\theta$) which has been obtained in this way is stored by the memory 108.

When the processing information (Ln, $\rho n$, $n\Delta\theta$) is obtained in this way, the arithmetic control circuit 100 obtains the displacement angle $d\theta n$, and then makes the displaced-angle memory 109 store the displacement angle $d\theta n$ as the processing information (Ln, $d\theta n$, $\rho n$, $n\Delta\theta$).

Thereafter, the arithmetic control circuit 100 calls the displacement angle $d\theta n$ at intervals of $n\Delta\theta$ from the processing information (Ln, $d\theta n$, $\rho n$, $n\Delta\theta$) which has been stored by the displaced-angle memory 109, and then judges whether or not the displacement angle dθn is wider than the designed angle values Δθx, Δθx, Δθy. In this embodiment, the designed angles Δθx, Δθy are designed to be 2°, 4°, respectively.

Besides, in the case where the displacement angle dθn is narrower than the designed angle value a Δθx, the arithmetic control circuit judges the lens to have a reference designed speed grinding configuration and allows the configuration information memory 107 to store the rotational speed correction code am, as a1, at which the corrected rotational speed Vn corresponds to v1. Further, in the case where the displacement angle dθn is between the designed values Δθx, Δθy (Δθx<Δθy), the arithmetic control circuit judges the lens to have a straight line configuration and allows the configuration information memory 107 to store the rotational speed correction code am, as a2, at which the corrected rotational speed Vn corresponds to v2 (v1<v2). Further, in the case where the displacement angle dθn is wider than the designed value Δθy, the arithmetic control circuit judges the lens to have a concave configuration and allows the configuration information memory 107 to store the rotational speed correction code am, as a3, at which the corrected rotational speed Vn corresponds to v3 (v2<v3).

In this embodiment, as shown in FIG. 6*a*, the rotational speed correction codes a1, a2, a3 are designed to be "0", "1", "2", respectively. The rotational speed correction code am which is obtained at intervals of the rotational angle nΔθ in the way mentioned above is stored as the eyeglass-configuration information (ρn, nΔθ, am) as well as the eyeglass-configuration data (ρn, n Δθ) by the configuration information memory 107.

Herein, firstly, the displacement angle dθn is 2.52, 5.4 at Intervals 6, 7, respectively, and thus the displacement angle dθn is between 2° and 4° at Intervals 6, 7. As a result, the rotational speed correction code becomes "1" of a2 at Intervals 6, 7. Secondly, the displacement angle dθn is 4.68, 9 at Intervals 801, 802, respectively, and thus the displacement angle dθn is more than 4° at Intervals 801, 802. As a result, the rotational speed correction code becomes "2" of a3 at Intervals 801, 802. Next, the displacement angle dθn is equal to or less than 2° at the rest of Intervals, the rotational speed correction code becomes "0" of a1.

(3) Calculation Of The Adjusted Rotational Speed Vn Per Datum At Intervals Of nΔθ

Further, the arithmetic control circuit 100 calls, from each of the reference-rotational-speed memory 106 and the correction table memory 105, a correction coefficient ki corresponding to the reference rotational speed Vbi and the rotational speed correction code am which have been varied with the material quality of the lens LE. Herein, as shown in FIGS. 6*b* and 6*c*, glass, or resins such as plastics, polycarbonate, or acrylic, is considered to be used as the material of the lens LE.

As shown in FIG. 6*b*, according to the material quality of the lens LE, the reference-rotational-speed memory 106 stores the reference rotational speed Vbi, such as the reference rotational speeds Vb1, Vb2, Vb3, Vb4 each of which is applied to coarse-processing, mortar-processing, plane-processing, and specular processing (finish-processing), respectively.

In short, in this embodiment, the reference rotational speeds Vb1, Vb2, Vb3, Vb4 of glass are 10, 12, 12, 15 seconds, the reference rotational speeds Vb1, Vb2, Vb3, Vb4 of plastics are 8, 12, 12, 15 seconds, the reference rotational speeds Vb1, Vb2, Vb3, Vb4 of polycarbonate are 13, 13, 13, 20 seconds, and the reference rotational speeds Vb1, Vb2, Vb3, Vb4 of acrylic are 13, 13, 13, 20 seconds, respectively.

As shown in FIG. 6*c*, according to the material quality of the lens LE, the correction table memory 105 stores the speed correction coefficients k0, k1, k2 with respect to the rotational speed correction codes a1 (the reference, i.e., the others), a2 (the judgment of a straight line), a3 (the judgment of a concave), respectively.

In short, in this embodiment, the speed correction coefficients k1, k2, k0 of glass are 1.3, 1.8, 1.0, the speed correction coefficients k1, k2, k0 of plastics are 1.5, 2.2, 1.0, the speed correction coefficients k1, k2, k0 of polycarbonate are 1.5, 2.5, 1.0, and the speed correction coefficients k1, k2, k0 of acrylic are 1.5, 2.2, 1.0, respectively.

In addition, the arithmetic control circuit 100 reads the rotational speed correction code am at intervals of nΔθ from the configuration information memory 107, and then obtains the corrected rotational speed Vn of the lens at intervals of nΔθ according to the read correction code am, the speed correction coefficient k1, and the reference rotational speed Vbi. Then, the arithmetic control circuit 100 allows the lens processing data memory 104 to store the corrected rotational speed Vn which has been obtained, as well as the data (ρn, nΔθ), as data (ρn, nΔθ, Vn) used for processing.

In short, when specular processing (fine processing) of the plastic lens LE is performed, in this embodiment, the per-rotation reference rotational speed Vb4 is 15 seconds. Therefore, the rotational speed ΔV with respect to every datum (the rotational angle nΔθ, i.e., each Interval n) can be obtained according to the per-rotation reference rotational speed Vb4. In this embodiment, since each Interval n is designed to be 1,000 (n=1,000), the rotational speed Δv becomes 15 msec. by the calculation of Δv=Vb4/1,000=15/1,000=15 msec.

On the other hand, each of the speed correction coefficients k1, k2, k0 corresponds to the rotational speed correction codes a2, i.e., "1", a3, i.e., "2", a1, i.e., "0", respectively. Consequently, the corrected rotational speed Vn with respect to every datum becomes k1×Δv when the rotational speed correction code is a2 of the straight-line judgment, i.e., "1", k2×Δv when it is a3 of the concave judgment, i.e., "2", and k0×Δv when it is a1 of the other judgments, i.e., "0", respectively. Besides, the speed correction coefficients k1, k2, k0 are 1.5, 2.2, 1.0, respectively, in the case where the lens LE is plastics. Therefore, the corrected rotational speed Vn with respect to every datum (Δθ=0.36°) in the case where the lens LE is plastics becomes k1×Δv=1.5×15 msec.=22.5 msec. when it is a2 of the straight-line judgment, i.e., "1", k2×Δv=2.2×15 msec.=33 msec. when it is a3 of the concave judgment, i.e., "2", and k0×Δv=1.0×15 msec.=15 msec. when it is a1 of the other judgments, i.e., "0", respectively.

Vn obtained in this way is, as shown in FIG. 6*a*, stored at intervals of nΔθ by the lens processing data memory 104.

(B) Lens-Rim Grinding

Next, in the case where the material of the lens is plastics, and the configuration of an eyeglass to be processed is a grinding form of a rimless frame, there will be explained grinding of the rim of the lens.

In an initial position before lens grinding is performed, the lens LE held between the lens rotating shafts 16, 17 is positioned on the coarse grindstone 6*a* of the grindstone 6. In this state, the processing-starting switch 4*g* used to start the lens grinding is turned on.

When the Processing-starting switch 4*g* has been turned on, the arithmetic control circuit 100 controls a rotational drive of the motor 7 by medium of the drive controller 101, then drives rotationally the grindstone 6, then drives rotationally the pulse motors 18, 45 by medium of the drive controller 101, and then the grinding of the rim of the lens LE which is made by the coarse grindstone 6a of the grindstone 6 is started.

The lens rotating shafts 16, 17, which are rotated by the pulse motor 18, take 12 seconds, the same time as plane-processing, to make one rotation. In this time, the arithmetic control circuit 100 reads the processing data (ρn, nΔθ, Vn) which have been stored by the lens processing data memory 104, then controls the drive of the pulse motor 45 according to the radius vector ρn of the processing data (ρn, nΔθ, Vn) and the rotational angle nΔθ, and then adjusts the between-axes distance In (=R+ρn) between a rotational-center line (a rotational-axis line) of the lens rotating shafts 16, 17 and a rotational-center line (a rotational-axis line) of the grindstone 6. In this way, while the between-axes distance Ln is being adjusted by the arithmetic control circuit 100, the rim of the lens LE is ground into the eyeglass configuration by the coarse grindstone 6a of the grindstone 6 in a state where its part to be ground in finish-grinding remains.

After the plane-processing has been completed, the arithmetic control circuit 100 controls an operation of the variable motor 31 by medium of the drive controller 101 while being detecting a position of the carriage 15 according to an output given by the rotary encoder 34, and then moves the carriage 15 in the right direction and also moves the lens LE between the lens rotating shafts 16, 17 onto the finishing grindstone 6c.

Thereafter, the arithmetic control circuit 100 controls a rotational drive of the motor 7 by medium of the drive controller 101 then drives rotationally the grindstone 6, then drives rotationally the pulse motors 18, 45 by medium of the drive controller 101, and then the specular grinding of the rim of the lens LE which is made by the coarse grindstone 6a of the grindstone 6 is started.

In this time, according to the rotational angle nΔθof the processing data (ρn, nΔθ, Vn) which have been stored by the lens processing data memory 104 and the corrected speed Vn, the arithmetic control circuit 100 controls the rotational speed of the pulse motor 18 with respect to every datum. For example, in the aforementioned plastics, the rotational speed of the lens rotating shafts 16, 17 which is given by the pulse motor 18 is designed to be 15 msec. at Intervals 1 to 5, 22.5 msec. at Intervals 6, 7, and 33 msec. at Intervals 801, 802.

In this way, since the rotational speed of the lens rotating shafts 16, 17 which is given by the pulse motor 18 is designed to be 22.5 msec. at Intervals 6, 7, and 33 msec. at Intervals 801, 802, the rotational angular speed of the lens rotating shafts 16, 17 at Intervals 6, 7, 801, 802 is made lower, so that a period of time during which the rim of the lens LE stays in contact with the finishing grindstone 6c at Intervals 6, 7, 801, 802 can be made substantially constant regardless of the configuration of the straight line portion, the concave portion, and the other portions. As a result, regardless of the configuration of the straight line portion, the concave portion, and the other portions, the rim of the lens LE can be ground substantially uniformly into the eyeglass configuration.

Second Embodiment

<Construction>

In the first embodiment explained above, there has been shown a construction where the grindstone 6 consists of the coarse grindstone 6a, the grindstone 6b having V-shaped grooves (the mortar-processing grindstone), and the finishing grindstone 6c (the fine abrasive grindstone), however, the construction of the grindstone is not necessarily limited to the construction shown in the first embodiment.

Figure 7A:
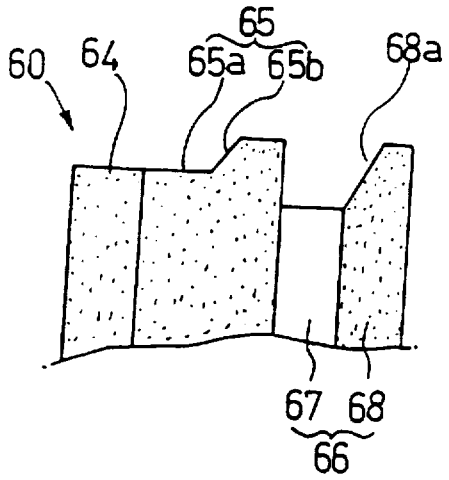
FIGS. 7*a* to 7*f* are each a partial schematic view of a grindstone, showing another example of the grindstone shown in FIG. 1*a*.
Figure 7B:
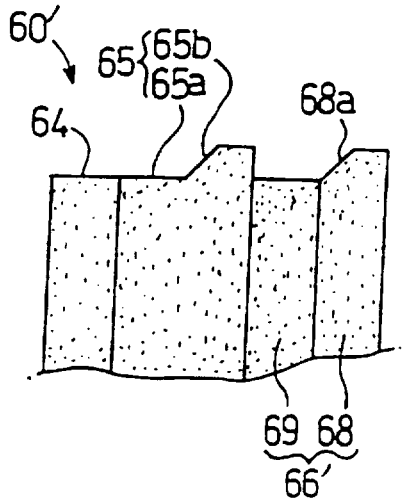
Figure 7C:
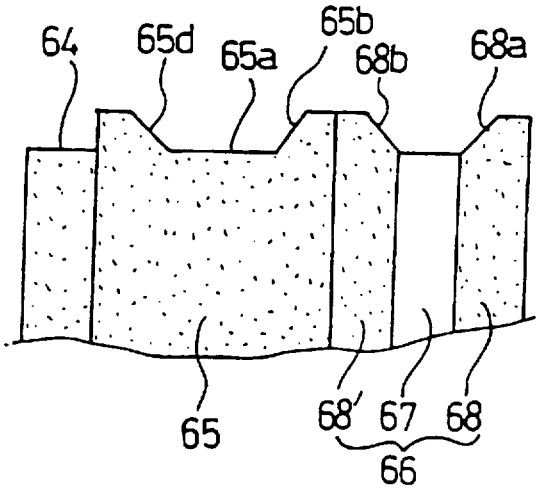
Figure 7D:
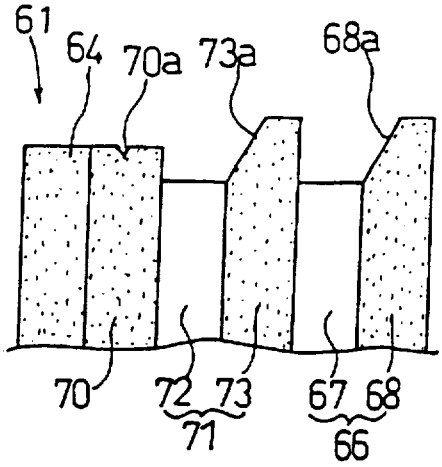
Figure 7E:
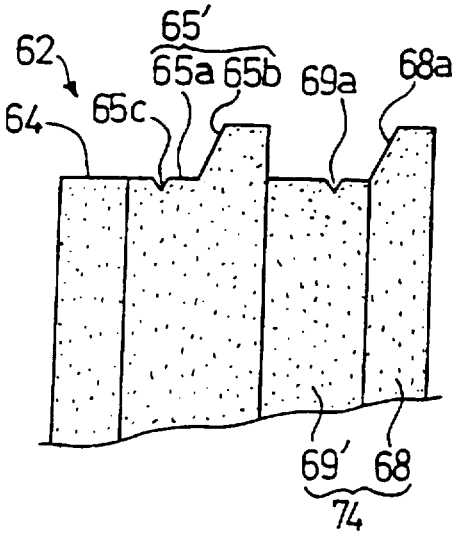
Figure 7F:
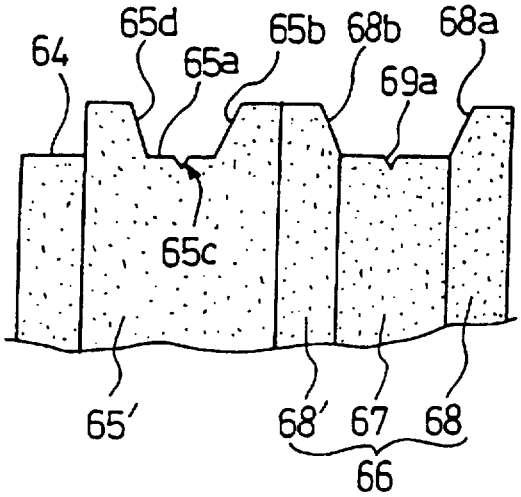

For example, grindstones 60, 60', 60a shown in FIGS. 7a, 7b, 7c each of which has both of a plane-grinding function and a slim-processing function, a grindstone 62 shown in FIG. 7d which has all of a mortar-grinding function, a plane-grinding function, and a slim-processing function, or grindstones 63, 63' shown in FIGS. 7e, 7f each of which has both of a mortar-grinding function and a slim-grinding function, can be substituted for the grindstone 6 in the first embodiment.

Herein, the slim-grinding (the slim-processing) indicates processing where chamfering is performed on the edge of the lens, and thus the edge thickness is made shorter.

The aforementioned grindstone 60 in FIG. 7a includes a coarse grindstone 64, a medium-finishing grindstone (a fine abrasive grindstone) 65, a superslim-finishing grindstone (a fine abrasive grindstone) 66. A medium-finishing plane grindstone surface 65a and an inclined medium-finishing slim grindstone surface (a slim-grinding surface used for edge chamfering) 65b are disposed on the circumferential surface of the medium-finishing grindstone 65. The superslim-processing medium-finishing grindstone 66 includes a platform 67, and a superfinishing-processing grindstone 68 having an inclined slim-grinding surface 68a.

The grindstone 60' in FIG. 7b is an example of the grindstone where a finishing grindstone (a fine abrasive grindstone) 66' is substituted for the slim-processing finishing grindstone 66 in FIG. 7a. The finishing grindstone 66' is a grindstone where a medium-finishing plane grindstone 69 is substituted for the platform 67 in FIG. 7a.

Besides, the grindstone 60a in FIG. 7c is provided with medium-finishing slim grindstone surfaces (slim-grinding surfaces used for edge chamfering) 65b, 65d which are inclined in a direction of opening widely to each other in the medium-finishing grindstone 65 of the grindstone 60 in FIG. 7a, and also with a superfinishing-processing grindstone 68 having a slim-processing grindstone surface 68b which is added to the slim-processing finishing grindstone 66. The slim-processing grindstone surfaces 68a, 68b are inclined in a direction of opening widely to each other. The slim-processing grindstone surfaces 65b, 65d, and 68a, 68b of the grindstone 60a are used to chamfer the edge between the edge surface and the front-side bent surface of the lens, and the edge between the edge surface and the back-side bent surface of the lens.

Further, a grindstone 70 shown in FIG. 7d is an example of the grindstone where a V-shaped-groove grindstone (a mortar-processing grindstone) 70 and a slim-processing medium-finishing grindstone 71 are substituted for the medium-finishing grindstone 65 in FIG. 7a. The slim-processing medium-finishing grindstone 71 includes a platform 72, and a slim-medium-finishing processing grindstone (a fine abrasive grindstone) 73 having an inclined slim-medium-finishing grinding surface 73a. 70a in FIG. 7c designates a V-shaped groove (a mortar groove) of the V-shaped-groove grindstone 70.

Further, a grindstone 62 shown in FIG. 7e is an example of the grindstone where each of a mortar grindstone 65' in FIG. 7b and a finishing grindstone 74 are substituted for the finishing grindstones 65, 66', respectively. A V-shaped groove (a mortar groove) 65c which opens to the medium finishing plane grindstone surface 65a and extends in the circumferential direction is formed in the medium-finishing grindstone 65 in FIG. 7b so as to form the mortar grindstone 65'. The mortar grindstone 74 is provided with a mortar grindstone 69' and the slim-grinding surfaces 68a. Herein, a V-shaped groove (a mortar groove) 69a which opens to the circumferential surface and extends in the circumferential direction is formed in the finishing grindstone 69 in FIG. 7c so as to form the mortar grindstone 69'.

Besides, a grindstone 62' in FIG. 7*f* is provided with medium-finishing slim grindstone surfaces (slim-grinding surfaces used for edge chamfering) 65*b*, 65*d* which are inclined in a direction of opening widely to each other in the medium-finishing grindstone 65 of the grindstone 62 in FIG. 7*e*, and also with a superfinishing-processing grindstone 68' having a slim-processing grindstone surface 68*b* which is added to the slim-processing finishing grindstone 66. The slim-processing grindstone surfaces 68*a*, 68*b* are inclined in a direction of opening widely to each other. The slim-processing grindstone surfaces 65*b*, 65*d*, and 68*a*, 68*b* of the grindstone 60*a* are used to chamfer the edge between the edge surface and the front-side bent surface of the lens, and the edge between the edge surface and the back-side bent surface of the lens.

<Function>

(The Judgment Of The Slim-Processing)

In the case where the aforementioned grindstones 60, 60', 61, 62 shown in FIGS. 7*a* to 7*f* are adjusted to the construction in the first embodiment, the arithmetic control circuit 100 is designed to judge whether or not the slim-processing should be performed. In the case where an eyeglass configuration 90 is taken from the lens LE in FIG. 9*a*, for example, this judgment is given according as whether or not a part W2 which is equal to or longer than a designed value W1 exists at an edge thickness W (see FIG. 9*b*) in an angular range α of 320° to 40° of the lens configuration 90. In the case where there is the part W2 equal to or longer than the value W1, the arithmetic control circuit 100 is designed to judge that the slim-processing should be performed.

In this embodiment, for example, the judgment is given according as whether or not there is a part having W1 of 5 mm or longer at the edge thickness W in the angular range α. In the case where there is the part having W1 of 5 mm or longer, it is designed to judge that the slim-processing should be performed. However, even in the case where there is a part having an edge thickness of more than 5 mm out of the angular range α, it can also be designed to judge that the slim-processing should be performed. In other words, the standard of judgment on whether the slim-processing should be performed is not limited to 5 mm.

On the other hand, with respect to the judgment on the slim-processing in the mortar processing, in the case where the eyeglass configuration 9O is taken from the lens LE in FIG. 9*a*, for example, this judgment is given according as whether or not there is a part which is equal to or longer than a designed value Wb at an edge thickness Wa from the apex TP of a mortar S of the eyeglass configuration to the reverse side of the edge (the backside bent surface Lb). In the case where there is a part equal to or longer than the thickness Wb, the arithmetic control circuit 100 is designed to Judge that the slim-processing should be performed.

In this embodiment, for example, the judgment is given according as whether or not there is a part having Wb of 3 mm or longer at the edge thickness Wa in the angular range α. In the case where there is the part having Wb of 3 mm or longer, it is designed to judge that the slim-processing should be performed. However, even in the case where there is a part having an edge thickness of more than 3 mm out of the angular range α, it can also be designed to judge that the slim-processing should be performed. In other words, the standard of judgment on whether the slim-processing should be performed is not limited to 3 mm.

When the arithmetic control circuit 100 has judged that the slim-processing should not be performed, the mortar-processing is performed in the range of the ordinary plane-processing.

Incidentally, in this embodiment, means for measuring the thickness of a lens edge is disposed in a grinding machine, and the edge thickness in the eyeglass configuration of the lens is measured by the lens-edge-thickness measuring means, although a figure of this mechanism and the explanation of this operation have been deleted. The edge-thickness measuring means has a well-known conventional construction, wherein the distance between a pair of feelers each of which comes into contact with a front-side bent surface Lf and the backside bent surface Lb, respectively, of the lens LE in FIGS. 9*b* to 9*f*, is obtained according to the lens-configuration information (ρn, nΔθ). The lens-edge thickness in the lens-configuration information (ρn, nΔθ) of the eyeglass configuration is obtained by the measuring means. Herein, the eyeglass configuration corresponds to a lens frame configuration in the case of an eyeglass frame, on the other hand, it corresponds to the eyeglass configuration of a model-grinding-form (a form plate) in the case of a rimless frame.

(Slim-Processing)

In the case where the arithmetic control circuit 100 has judged that slim-processing should be performed when plane-processing is performed, the grindstones 60, 60', or 60*a* shown in FIG. 7*a*, FIG. 7*b*, or FIG. 7*c*, respectively, is used. On the other hand, in the case where the arithmetic control circuit 100 has judged that slim-processing should be performed when mortar-processing is performed, the grindstones 61, 62, or 62' shown in FIG. 7*d*, FIG. 7*e*, or FIG. 7*f*, respectively, is used.

Hereinafter, there will be explained the plane-processing where the grindstone 60 in FIG. 7*a* is used, and the mortar-processing where the grindstone 61 in FIG. 7*c* is used.

Figure 8A:
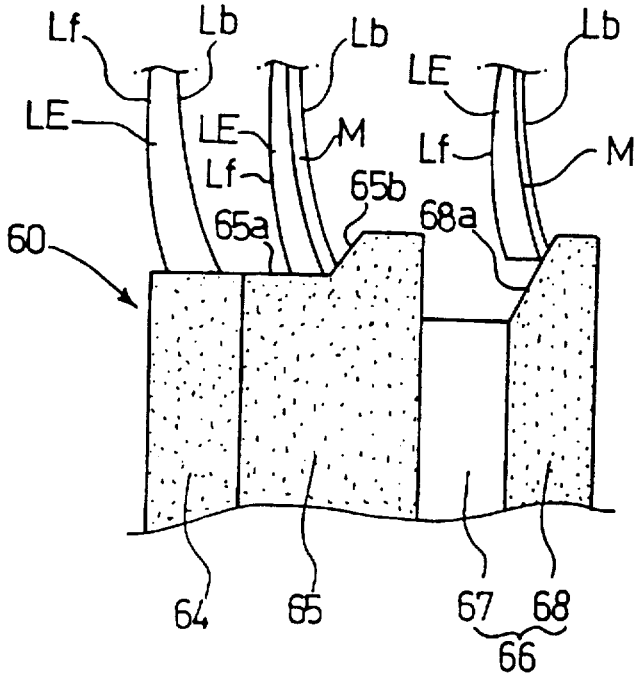
FIGS. 8*a* and 8*b* are each a partial schematic view of the grindstone shown in FIGS. 7*a* and 7*d*, respectively, showing a state where the grindstone is being used.

In the case where slim-grinding of the edge L1 of the lens is also performed at the time when the rim of the lens LE is ground into the rimless-frame eyeglass configuration, at first, as shown in FIG. 8*a*(a), the rim of the lens LE is substantially ground into the eyeglass configuration by the coarse grindstone 54 in a state where its part to be ground in finish-grinding remains. Next, as shown in FIG. 8*a*(b), the finish-ground part of the lens LE is ground into the eyeglass configuration with the medium-finishing plane grindstone surface 65*a* of the medium-finishing grindstone 65, and in addition, a chamfered portion M is formed with the slim-processing grindstone surface 65*b* on the side of the back-side bent surface Lb inside the edge of the lens LE in FIG. 9*b* and FIG. 9*d*. In this case, the chamfered portion M is formed in the part W2 longer than the value W1 (5 mm in this embodiment). Finally, as shown in FIG. 8*a*(c), the chamfered portion M is polished with the slim-grinding surface 68*a* of the superslim-processing finishing grindstone 66.

Figure 8B:
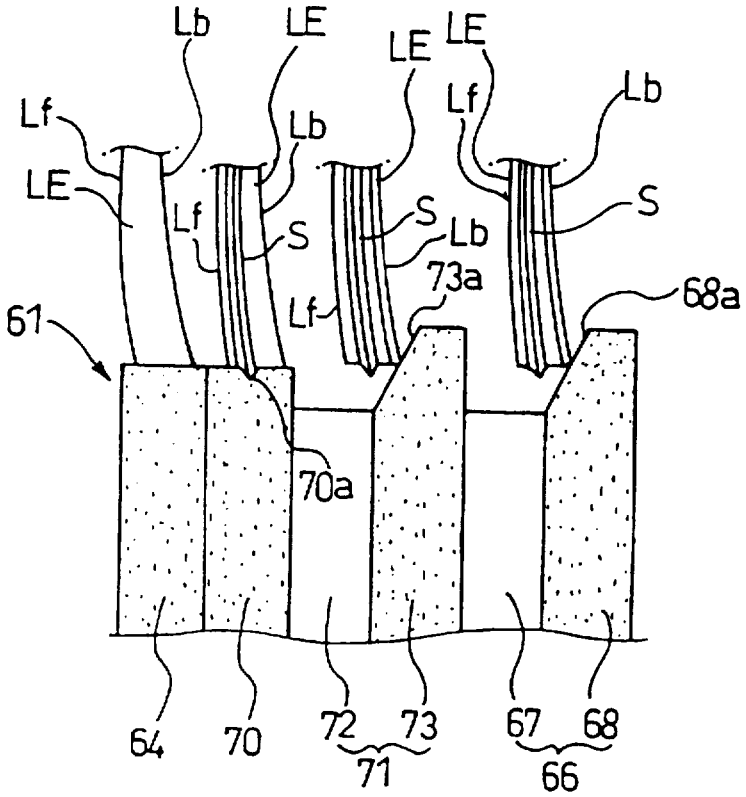

Herein, the mortar-processing is performed with the grindstone 61 in FIG. 7*c*, as shown in FIG. 8*b*(a), the rim of the lens LE is substantially ground into the eyeglass configuration with the coarse grindstone 64 in a state where its part to be ground in finish-grinding remains. Next, as shown in FIG. 8*b*(b), the rim of the lens LE is ground into the lens frame configuration with the mortar grindstone 70 in a state where the finish-ground part remains in the rim of the lens LE. Thereafter, as shown in FIG. 8*b*(c), the chamfered portion M is formed with the slim-medium-finishing grinding surface 73*a* of the slim-medium-finishing processing grindstone 73 on the side of the backside bent surface Lb inside the edge of the lens LE in FIG. 9*c* and FIG. 9*e*. In this case, the chamfered portion M is formed in the part Wc longer than the value Wb (3 mm in this embodiment). Finally, as shown in FIG. 8*b*(d), the chamfered portion M is polished with the slim-grinding surface 68*a* of the superslim-processing finishing grindstone 66.

When the finish-grinding is performed with the aforementioned fine abrasive grindstones 65, 65', 66, 66', 71, 74, or the like, the arithmetic control circuit 100 controls the rotational speed of the lens in the same way as the finish-grinding of the lens which is performed with the finishing grindstone 6*c* in the first embodiment.

A grinding operation is made by some of these grindstones 60, 60', 61, 62, and such, and thereby the judgment on whether or not the edge thickness of the lens which has been ground into the eyeglass configuration should be shortened in the slim-processing can be given with higher speed, and in addition, the slim-processing can be performed in a shorter period of time, that is, in several tens of seconds to several minutes, than one which is conventionally taken for a skilled operator to perform it manually, that is, in 30 to 40 minutes.

As explained heretofore, by a method of processing the rim of a lens according to the present invention, the rim of a lens to be processed is ground into an eyeglass configuration by a grindstone while the lens is rotated and is moved forward to and backward from the grindstone at intervals of a rotational angle $n\Delta\theta$, according to data ($\rho n$, $n\Delta\theta$) which are measured by means for measuring a lens frame configuration and are used for the lens-rim processing. Further, by the lens-rim processing method, there are obtained a displacement angle $d\theta n$ between an assumed processing point at a radius vector $\rho n$ of the rotational angle $n\Delta\theta$ [n=0, 1, 2, 3, . . . i] and a true processing point where the lens comes into contact with the grindstone at the rotational angle $n\Delta\theta$, according to the data ($\rho n$, $n\Delta\theta$) and the curvature radius of the grindstone.

According to the method of grinding the rim of a lens, an angle in which a position where a lens to be processed comes into contact with a grindstone is displaced in a circumferential direction, which varies with an eyeglass configuration, is obtained, and thus the "processing interference" can be controlled to be prevented. Further, according to the method, a period of time during which the grindstone stays in contact with the lens is regulated while the displaced length according to the displacement angle is being considered, and thus the lens can be ground accurately into the eyeglass configuration.

Further, in the case where the displacement angle $d\theta n$ between the assumed processing point at the radius vector $\rho n$ of the rotational angle $n\Delta\theta$ [n=0, 1, 2, 3, . . . i] and the true processing point where the lens comes into contact with the grindstone at the rotational angle $n\Delta\theta$ is obtained according to the data ($\rho n$, $n\Delta\theta$) and the curvature radius of the grindstone, and then a rotational angular rate of the lens is controlled such that a period of time during which the grindstone stays at the rotational angle $\Delta\theta$ can be made substantially constant according to the displacement angle $d\theta n$ at the rotational angle $n\Delta\theta$, a length in which the lens is ground is regulated while a length in which a position where a lens to be processed comes into contact with a grindstone is displaced in a circumferential direction, which varies with an eyeglass configuration, is being considered, and thus the lens can be ground accurately into the eyeglass configuration.

The aforementioned apparatus for processing the rim of a lens according to the present invention, which is used to attain the aforementioned object, comprises a pair of lens rotating shafts which are each disposed in a coaxial line and holds a lens to be processed between the opposite ends thereof, means for driving rotationally the lens rotating shafts, a rotatable grindstone which is disposed below the lens, means for making an up-and-down movement of the lens rotating shafts according to data ($\rho n$, $n\Delta\theta$) which are measured by means for measuring a lens frame configuration and are used for processing of the lens rim, an arithmetic control circuit for controlling the drive of the rotation driving means and the up-and-down means. Further, the arithmetic control circuit in the apparatus is designed to obtain a displacement angle $d\theta n$ between an assumed processing point P at a radius vector $\rho n$ of the rotational angle $n\Delta\theta$ [n=1, 2, 3, . . . i] and a true processing point P' where the lens comes into contact with the grindstone at the rotational angle $n\Delta\theta$, according to the data ($\rho n$, $n\Delta\theta$) and the curvature radius R of the grindstone.

According to the apparatus of grinding the rim of a lens, an angle in which a position where a lens to be processed comes into contact with a grindstone is displaced in a circumferential direction, which varies with an eyeglass configuration, is obtained, and thus the "processing interference" can be controlled to be prevented. Further, according to the apparatus, a period of time during which the grindstone stays in contact with the lens is regulated while the displaced length according to the displacement angle is being considered, and thus the lens can be ground accurately into the eyeglass configuration. The arithmetic and the control are made accurately and steadily by the arithmetic control circuit.

Further, in the case where the arithmetic control circuit in the apparatus is designed to obtain the displacement angle $d\theta n$ between the assumed processing point P at the radius vector $\rho n$ of the rotational angle $n\Delta\theta$ [n=0, 1, 2, 3, . . . i] and the true processing point P' where the lens comes into contact with the grindstone at the rotational angle $n\Delta\theta$ according to the data ($\rho n$, $n\Delta\theta$) and the curvature radius R of the grindstone, and to control a rotational angular rate of the lens rotating shafts such that a period of time during which the grindstone stays at the rotational angle $n\Delta\theta$ is made substantially constant according to the displacement angle $d\theta n$, a length in which the lens is ground is regulated while a length in which a position where a lens to be processed comes into contact with a grindstone is displaced in a circumferential direction, which varies with an eyeglass configuration, is being considered, and thus the lens can be ground accurately into the eyeglass configuration.

Further, in the case where the arithmetic control circuit is, firstly, in the case where the displacement angle $d\theta n$ is narrower than a designed angle value $\Delta\theta x$, constructed to judge the lens to have a reference designed speed grinding configuration and to allow a configuration information memory to store a rotational speed correction code am, as a1, at which a corrected rotational speed Vn corresponds to v1, secondly in the case where the displacement angle $d\theta n$ is between the designed value $\Delta\theta x$ and a designed value $\Delta\theta y$ ($\Delta\theta x<\Delta\theta y$), to judge the lens to have a straight line configuration and to allow the configuration information memory to store the rotational speed correction code am, as a2, at which the corrected rotational speed Vn corresponds to v2 (v1<v2), and thirdly in the case where the displacement angle $d\theta n$ is wider than the designed value $\Delta\theta y$, to judge the lens to have a concave configuration and to allow the configuration information memory to store the rotational speed correction code am, as a3, at which the corrected rotational speed Vn corresponds to v3 (v2<v3), and further, when grinding of the rim of the lens by the grindstone is performed, the arithmetic control circuit is constructed to call one of the rotational speed correction codes a1, a2, a3 which are stored at intervals of $n\Delta\theta$in the configuration information memory and to control the rotation driving means such that the corrected rotational speed Vn of the lens corresponds to any one of v1, v2, v3 (v1>v2>v3), a length in which the lens is ground is regulated while a length in which a position where a lens to be processed comes into contact with a grindstone is displaced in a circumferential direction, which varies with an eyeglass configuration, is being considered more accurately, and thus the lens can be ground accurately into the eyeglass configuration.

Further, in the case where the rotational speeds v1, v2, v3 are constructed to be varied with the material of the lens, a length in which the lens is ground is adjusted with higher accuracy according to the material, and thus the lens can be ground accurately into the eyeglass configuration.

Further, in the case where the arithmetic control circuit is constructed to call, from each of a memory used for a reference rotational speed and a correction table memory, a correction coefficient ki corresponding to the reference rotational speed and the rotational speed correction code am which have been varied with the material of the lens, then to read the rotational speed correction code am at intervals of nΔθ, then to find the corrected rotational speed Vn of the lens at intervals of nΔθaccording to the read rotational speed correction code am, the speed correction coefficient k1, and the reference rotational speed, then to allow a lens processing data memory to store the corrected rotational speed Vn as data (ρn, n Δθ, Vn) used for processing, as well as the data (ρn, nΔθ), and then to control the rotation driving means according to the processing data (ρn, nΔθ, Vn) which have been stored in the lens processing data memory, a length in which the lens is ground is regulated while a length in which a position where a lens to be processed comes into contact with a grindstone is displaced in a circumferential direction, which varies with an eyeglass configuration, and the reference rotational speed according to the material of the lens, are being considered, and thus the lens can be ground more accurately into the eyeglass configuration.

Further, in the case where the grindstone is constructed to include a coarse grindstone and a fine abrasive grindstone, and the fine abrasive grindstone can be provided with an inclined slim-processing grinding surface used for edge chamfering on the circumferential surface thereof, the edge of the lens can be chamfered when the finish-processing of the lens rim is performed with the fine abrasive grindstone.

What is claimed is:

1. A method of processing a rim of a lens, which comprises the step of grinding the rim of the lens to be processed with a grindstone so as to fit a configuration of an eyeglass while rotating and moving the lens toward and away from said grindstone at intervals of a rotational angle nΔθ, in accordance with data (ρn, nΔθ) for processing the rim of the lens, said data having obtained by configuration measuring means;

wherein, from said data (ρn, nΔθ) and a radius of curvature of said grindstone, a displacement angle dθn is calculated between an assumed processing point at a radius vector ρn of the rotational angle nΔθ [n=0, 1, 2, 3, . . . i] and a true processing point where the lens comes into contact with said grindstone at the rotational angle nΔθ.

2. A method of processing a rim of a lens, which comprises the step of grinding the rim of the lens to be processed with a grindstone so as to fit a configuration of an eyeglass while rotating and moving the lens toward and away from said grindstone at intervals of a rotational angle n Δ9 in accordance with data (ρn, nΔθ) for processing the rim of the lens, said data having obtained by a configuration measuring means;

wherein, from said data (ρn, nΔθ) and a radius of curvature of said grindstone, a displacement angle dθn is calculated between an assumed processing point at a radius vector ρn of the rotational angle nΔθ [n=0, 1, 2, 3, . . . i] and a true processing point where the lens comes into contact with said grindstone at the rotational angle nΔθ, and a rotational angular speed of the lens is controlled according to said displacement angle dθn at the rotational angle nΔθ so that time during which said grindstone stays at the rotational angle nΔθ becomes substantially constant.

3. An apparatus for processing a rim of a lens, comprising:

a pair of lens rotating shafts which are coaxially disposed and hold the lens to be processed therebetween;

rotation driving means for rotating said lens rotating shafts;

a rotatable grindstone disposed below the lens;

up-down means for raising and lowering said lens rotating shafts in accordance with lens processing data (ρn, nΔθ) measured by configuration measuring means for measuring a configuration of a lens frame; and an arithmetic control circuit for controlling said rotation driving means and said up-down means;

wherein according to said lens processing data (ρn, nΔθ) and a radius R of curvature of said grindstone, said arithmetic control circuit calculates a displacement angle dθn between an assumed processing point P at a radius vector ρn of a rotational angle nΔθ [n=0, 1, 2, 3, . . . i] and a true processing point P' where the lens comes into contact with said grindstone at the rotational angle nΔθ.

4. An apparatus for processing a rim of a lens, comprising:

a pair of lens rotating shafts which are coaxially disposed and hold the lens to be processed therebetween;

rotation driving means for rotating said lens rotating shafts;

a rotatable grindstone disposed below the lens;

up-down means for raising and lowering said lens rotating shafts in accordance with lens processing data (ρn, nΔθ) measured by configuration measuring means for measuring a configuration of a lens frame; and an arithmetic control circuit for controlling said rotation driving means and said up-down means;

wherein according to said lens processing data (ρn, nΔθ) and a radius R of curvature of said grindstone, said arithmetic control circuit calculates a displacement angle dθn between an assumed processing point P at a radius vector ρn of a rotational angle nΔθ [n=0, 1, 2, 3, . . . i] and a true processing point P' where the lens comes into contact with said grindstone at the rotational angle nΔθ, and controls a rotational angular velocity of said lens rotating shafts in accordance with said displacement angle dθn so that time during which said grindstone stays at said rotational angle nΔθbecomes substantially constant.

5. An apparatus for processing a rim of a lens according to claim 4, wherein if said displacement angle dθn is smaller than a predetermined angle Δθx, said arithmetic control circuit judges that the lens has a configuration to be ground at a predetermined reference speed and allows a configuration information memory to store a rotational speed correction code am in the name of a1 at which a corrected rotational speed Vn corresponds to a rotational speed v1; if said displacement angle dθn is between the predetermined angle Δθx and a predetermined angle Δθy (Δθx<Δθy), said arithmetic control circuit judges that the lens has a configuration of a straight line and allows said configuration information memory to store the rotational speed correction code am in the name of a2 at which the corrected rotational speed Vn corresponds to a rotational speed v2 (v1<v2); and if said displacement angle dθn is larger than the predetermined angle Δθy, said arithmetic control circuit judges that the lens has a concave configuration and allows said configuration information memory to store the rotational speed correction code am in the name of a3 at which said corrected rotational speed Vn corresponds to a rotational speed v3 (v2<v3), and said arithmetic control circuit calls one of said rotational speed correction codes a1, a2, and a3 which have been stored at intervals of nΔθ in said configuration information memory when the rim of the lens is ground and processed with said grindstone, and controls said rotation driving means so that said corrected rotational speed Vn of the lens corresponds to any one of the rotational speeds v1, v2, and v3 (v1>v2>v3).

6. An apparatus for processing a rim of a lens according to claim 5, wherein the rotational speeds v1, v2, and v3 differ from each other depending on material of the lens.

7. An apparatus for processing a rim of a lens according to claim 4, wherein said arithmetic control circuit calls a reference rotational speed depending on material of the lens and a speed correction coefficient ki corresponding to a rotational speed correction code am from a memory for the reference rotational speed and a correction table memory, respectively, then reads said rotational speed correction code am at intervals of the rotational angle nΔθ, then finds a corrected rotational speed Vn of the lens at intervals of the rotational angle nΔθ according to said rotational speed correction code am which has been read, said speed correction coefficient k1, and said reference rotational speed, then allows a lens processing data memory to store said corrected rotational speed Vn as processing data (ρn, nΔθ, Vn) as well as the data (ρn, nΔθ), and controls said rotation driving means according to said processing data (ρn, nΔθ, Vn) which have been stored in said lens processing data memory.

8. An apparatus for processing a rim of a lens according to one of claims 4 to 7, wherein said grindstone comprises a coarse grindstone and a fine abrasive grindstone, said fine abrasive grindstone having an inclined slim-processing grinding surface used for edge-chamfering on a circumferential surface thereof.

* * * * *

UNITED STATES PATENT AND TRADEMARK OFFICE

CERTIFICATE OF CORRECTION

PATENT NO. : 5,775,973
DATED : July 7, 1998
INVENTOR(S) : WATANABE

It is certified that error appears in the above-indentified patent and that said Letters Patent is hereby corrected as shown below:

Claim 1, col. 19, line 64, "nΔ9" should read --nΔθ,--.

Claim 4, col. 20, line 56, "nΔθbecomes" should read --nΔθ becomes--.

Signed and Sealed this

Fourteenth Day of September, 1999

*Attest:*

Q. TODD DICKINSON

*Attesting Officer*

*Acting Commissioner of Patents and Trademarks*